US009352609B2

(12) United States Patent
Yoshii et al.

(10) Patent No.: US 9,352,609 B2
(45) Date of Patent: May 31, 2016

(54) METHOD FOR COLLECTING LIQUID SURFACE RESIDUAL FILM, METHOD FOR TRANSFERRING LIQUID PRESSURE USING SAME, COLLECTION DEVICE THEREFOR, AND LIQUID PRESSURE TRANSFER DEVICE USING SAME

(75) Inventors: Youichiro Yoshii, Minato-ku (JP); Eiji Suzuki, Minato-ku (JP); Sakae Ushiwata, Minato-ku (JP)

(73) Assignee: TAICA CORPORATION, Tokyo (JP)

( * ) Notice: Subject to any disclaimer, the term of this patent is extended or adjusted under 35 U.S.C. 154(b) by 804 days.

(21) Appl. No.: 13/502,889

(22) PCT Filed: Oct. 27, 2010

(86) PCT No.: PCT/JP2010/069066

§ 371 (c)(1),
(2), (4) Date: May 17, 2012

(87) PCT Pub. No.: WO2011/052636

PCT Pub. Date: May 5, 2011

(65) Prior Publication Data

US 2012/0227769 A1 Sep. 13, 2012

(30) Foreign Application Priority Data

Oct. 28, 2009 (JP) ..... 2009-248174
Jan. 14, 2010 (JP) ..... 2010-005408

(51) Int. Cl.
*B08B 3/00* (2006.01)
*B08B 7/04* (2006.01)
*B08B 1/02* (2006.01)
(Continued)

(52) U.S. Cl.
CPC ..... *B44C 1/175* (2013.01); *B41F 16/006* (2013.01); *B44C 1/1758* (2013.01); *Y10T 137/0318* (2015.04); *Y10T 137/85978* (2015.04)

(58) Field of Classification Search
None
See application file for complete search history.

(56) References Cited

U.S. PATENT DOCUMENTS

2006/0060291 A1 3/2006 Yamamori et al.
2007/0298181 A1 12/2007 Kojima et al.

FOREIGN PATENT DOCUMENTS

JP A-2004-306602 11/2004
JP A-2005-162298 6/2005
(Continued)

OTHER PUBLICATIONS

JP2006123947 English Translation, accessed on May 22, 2015.*
(Continued)

*Primary Examiner* — Eric Golightly
*Assistant Examiner* — Arlyn I Rivera-Cordero
(74) *Attorney, Agent, or Firm* — Oliff PLC

(57) ABSTRACT

A method for collecting a liquid surface residual film floating on the surface of the liquid after transfer, and a transfer tank that includes a film holding mechanism, provided at inner sides of both right and left side walls, for holding both sides of the transfer film and conveying the transfer film to an immersion area. When a film that is no longer needed after the transfer is collected, dividing means divides the liquid surface residual film so as to split the liquid surface residual film in a longitudinal direction of the transfer tank before the object is removed from the transfer liquid, and the divided films are moved closer to the both side walls of the transfer tank. At the side wall portions, the film holding mechanism is canceled, and from this canceled portion, the divided liquid surface residual films are discharged out of the tank.

16 Claims, 20 Drawing Sheets

(51) Int. Cl.
*B44C 1/175* (2006.01)
*B41F 16/00* (2006.01)

(56) References Cited

FOREIGN PATENT DOCUMENTS

| | | | | |
|---|---|---|---|---|
| JP | A-2005-169693 | | 6/2005 | |
| JP | A-2006-88385 | | 4/2006 | |
| JP | 2006123947 | * | 5/2006 | ..... B41F 16/00 |
| JP | A-2006-123264 | | 5/2006 | |
| JP | A-2008-296471 | | 12/2008 | |
| JP | 2008213428 | * | 9/2009 | ..... B41F 33/14 |
| WO | WO 2006/061946 A1 | | 6/2006 | |

OTHER PUBLICATIONS

JP2008213428 English Translation, accessed on May 22, 2015.*
International Search Report issued in International Patent Application No. PCT/JP2010/069066 dated Jan. 25, 2011.

* cited by examiner (a)

(b)

(a)

(b)

METHOD FOR COLLECTING LIQUID SURFACE RESIDUAL FILM, METHOD FOR TRANSFERRING LIQUID PRESSURE USING SAME, COLLECTION DEVICE THEREFOR, AND LIQUID PRESSURE TRANSFER DEVICE USING SAME

TECHNICAL FIELD

The present invention relates to a liquid pressure transfer, in which a transfer film made by applying an appropriate transfer pattern (surface ink layer) with a transfer ink in advance is supported in a floating manner on a surface of a liquid, and while an object is pressed on the transfer film, the object is immersed into the transfer liquid, whereby the transfer pattern on the film is transferred onto the object using a liquid pressure thereof. More particularly, the present invention relates to a novel collecting method and a method for transferring liquid pressure thereof, wherein after the object is immersed into the transfer liquid, unnecessary residual films not used for the transfer and floating on the surface of the liquid are collected reliably and quickly, and the residual films do not reach the liquid-leaving area.

BACKGROUND ART

A liquid pressure transfer is known, in which a transfer film made by applying an appropriate water-insoluble transfer pattern with transfer ink on a water-soluble film (holding sheet) in advance is set in the transfer tank (transfer liquid) so that the transfer film floats on the transfer liquid, and while the transfer film (water-soluble film) is wet with the transfer liquid (in short, water), the object is pressed onto the liquid in the transfer tank while the object is brought into contact with the transfer film, and using the liquid pressure, the transfer pattern on the film is transferred and formed on the surface of the object. As described above, on the transfer film, the transfer pattern is formed (printed) on the water-soluble film with ink in advance, and the ink of the transfer pattern is in a dried state. Therefore, during the transfer, it is necessary to apply an activating agent, a thinner, and the like to the transfer pattern on the transfer film to return the transfer pattern back to a wet state like the state immediately after the printing of the transfer pattern, i.e., to return the transfer pattern back to a state achieving the adhesive property, and this is referred to as activation.

Then, after the transfer, the half-dissolved water-soluble film is removed by water-cleaning and the like from the object removed from the transfer tank, and thereafter, the object is dried. In order to protect the decorative layer formed and transferred onto the object, the object is subjected to top coating in many cases. However, in this kind of conventional liquid pressure transfer, first, solvent-based clear coating is used for the top coating, and there is a problem in that the environmental impact is high, and moreover, since, e.g., there is a defect during the top coating and it takes a relatively long time and energy in the coating and drying, the overall cost of the liquid pressure transfer increases.

Therefore, a method has been devised, in which during the liquid pressure transfer, a transfer pattern also having a surface protection function is formed on an object, and after the transfer, this is cured to form a decorative layer, so that the top coating is omitted (for example, see Patent Literatures 1, 2).

Among them, Patent Literature 1 relates to a method in which, while a conventional transfer film made by forming only a transfer pattern on a water-soluble film is used, a curable resin composition (liquid) is used as an activating agent, and ultraviolet rays are emitted onto the object after the transfer, so that a curable resin composition (surface protection layer) formed integrally with the transfer pattern is cured.

On the other hand, Patent Literature 2 relates to a method in which a transfer film made by forming a curable resin layer between a water-soluble film and a transfer pattern is used, and the curable resin layer on the transfer pattern is cured by emitting active energy rays such as ultraviolet rays onto the object or heating the object after the transfer.

By the way, in the liquid pressure transfer, when the object is immersed into the liquid (during the transfer), such operation is performed that the object pierces through the transfer film floating on the surface of the liquid and sinks into the liquid, and for this reason, after the object sinks into the liquid, the film remaining on the surface of the liquid is no longer used for the transfer and is unnecessary (this will be referred to as liquid surface residual film).

When the object pierces through the transfer film on the surface of the liquid, a large amount of very small film residues (for example, in a form of waste strings made up with the water-soluble film and the ink which are mixed) are dispersed and discharged into the transfer liquid, and these are accumulated in the transfer liquid.

Usually, the object is immersed into the liquid (transferred) with a jig attached thereto, and when the object is immersed into the liquid, redundant films attached to the jig and the object may be separated and discharged in the liquid.

For this reason, the liquid surface residual films, the film residues, the redundant films, and the like explained above may attach to the design surface of the object pulled up from the transfer liquid (these remain in the liquid and the transfer liquid surface and are unnecessary after the transfer, and therefore, in this specification they are collectively referred to as "foreign substances").

Further, for example, as shown in FIG. 19(*a*), in a case where the object W has an opening portion Wa in the design surface S1, a thin film M made of a water soluble material of the water-soluble film is often formed in the opening portion Wa when the object is pulled up from the surface of the liquid, and this bursts, whereby bubbles A attach to the design surface S1 of the object W, or when the transfer liquid L drops to the surface of the liquid from a protruding portion of the object W or an upper edge portion of the opening portion Wa, bubbles A are generated on the surface of the liquid, and the bubbles may attach to the design surface S1. More specifically, in FIG. 19(*a*), at first, the thin film M is formed in the frame of the jig J, and the burst residual bubbles A float on the surface of the transfer liquid L. According to the movement of the surface of the liquid in the liquid-leaving area P2 (relative descend as the object W is pulled up), the bubbles A are incorporated into the thin film M formed in the opening portion Wa of the object W. Thereafter, the burst residues of the thin film M float on the surface of the liquid as the bubbles A, and the bubbles A indirectly attach to the design surface S1, or the bubbles A are directly passed along the surface of the object W, and attach to the design surface S1. As a result, the state as shown in FIG. 19(*b*) is obtained.

Then, when curing processing is performed by emission of active energy rays and/or heating in this state, for example, as shown in FIG. 19(*c*), the following defects occur. Only in portions to which the bubbles A attach, a defect of deformation of the pattern of the decorative layer (the transfer pattern and the surface protection layer) and a defect (so called pinhole defect) of loss of the pattern may occur in the portions occur because of the reasons such as stress caused by the bubbles A and refraction caused by the active energy rays. It is to be understood that the above defect of the deformation of the pattern and the defect of the loss of the pattern are not limited to a case where the bubbles A attach to the object W. This is a phenomenon that may also occur when foreign substances such as the liquid surface residual films, the film residues, and the redundant films attach to the design surface S1. In this case, reference numeral f in the figure mainly denotes the decorative layer transferred to the object W (design surface S1) and the like. Therefore, during the liquid pressure transfer, it is particularly important to prevent the liquid surface residual films, the film residues, the redundant films, the bubbles A, and the like from attaching to the design surface S1 as much as possible in the liquid pressure transfer for forming the transfer pattern also having the surface protection function. It should be noted that a product with the defect of pattern deformation and/or the defect of pattern loss (liquid pressure transfer product) are once subjected to the curing processing, projection and depression caused by the pattern deformation and the pattern loss are significant, but it is impossible to perform the transfer all over again (impossible to reproduce), and therefore, the above defects significantly reduces the mass productivity, and a fundamental solution method for reducing the defective rate itself is strongly desired.

It is to be understood that the liquid surface residual films floating on the surface of the liquid after the transfer have been collected in the past, and, for example, the overflow structures provided at the end of the transfer tank are used to collect them. More specifically, this is a method in which, after the transfer, the liquid surface residual films as well as the transfer liquid are caused to flow into the overflow tanks at the end of the transfer tank, and when the transfer liquid collected there are used for recycle, the liquid surface residual films are removed and collected by a filter and the like provided in a path.

However, in this kind of collecting method, the liquid surface residual films pass through the liquid-leaving area. Therefore, in particular, in liquid pressure transfer for forming even a surface protection layer during liquid pressure transfer, this collecting method cannot be said effective collection means, and more active collecting method is desired, and there is such method that has already been devised (for example, in addition to Patent Literature 2 explained above, see Patent Literatures 3 and 4).

First, Patent Literature 2 discloses a method in which every time the liquid pressure transfer is performed, all residual films on water surface are pushed and washed away from a transfer tank by providing water into the tank from a bottom portion of the transfer tank. On the other hand, Patent Literature 3 discloses a method for sucking films on water surface using vacuum while an object is immersed under the water. Further, Patent Literature 4 discloses a method, in which after an object is pulled up from a water tank, air is blown to one end of the water tank, and transfer residues and remaining residues are washed away from the one end of the water tank after an ink coat is transferred onto the object.

However, these are mainly intended for collecting films and residues on the transfer liquid surface (on the water surface). Moreover, these require extensive structure, and are batch processing method in which films and residues are collected on every transfer, and therefore, it takes a long time and the efficiency is low, which cannot be necessarily said a preferable method.

CITATION LIST

Patent Literature

Patent Literature 1: Japanese Patent Application Laid-Open (JP-A) No. 2005-169693

Patent Literature 2: JP-A No. 2005-162298

Patent Literature 3: JP-A No. 2004-306602

Patent Literature 4: JP-A No. 2006-123264

SUMMARY OF INVENTION

Technical Problem

The present invention has been made in view of such background, and is a method capable of performing collecting process quickly and reliably from when an object is immersed into a liquid (after the transfer) to when the object is removed out of the liquid, wherein the method hardly gives adverse effects such as deformation of a transfer film existing at a transfer position. In addition, a novel method for collecting a liquid surface residual film and a novel method for transferring liquid pressure using a relatively simple structure at a low cost have been developed.

Solution to Problem

First, a method for collecting a liquid surface residual film for liquid pressure transfer is configured such that a transfer film made by forming at least a transfer pattern on a water-soluble film in a dried state is supported in a floating manner on a surface of a liquid in a transfer tank, and an object is pressed on the transfer film from above, whereby the transfer pattern is transferred onto the object using a liquid pressure generated thereby, wherein the liquid surface residual film is not used for the transfer and floats on the surface of the liquid after the object is immersed into the liquid, wherein when the object immersed into the liquid is removed out of the transfer liquid, the object is pulled up from a liquid-leaving area at a downstream side that is different from an immersion area, the transfer tank includes a film holding mechanism, provided at inner sides of both right and left side walls, for coming into contact with and holding both sides of the transfer film supplied to the transfer tank and conveying the transfer film to at least the immersion area where the transfer is performed, when the liquid surface residual film, that is no longer needed after the transfer, is collected, dividing means divides the liquid surface residual film so as to split the liquid surface residual film in a longitudinal direction of the transfer tank from when the object is immersed into the transfer liquid to when the object is removed from the transfer liquid, and the divided liquid surface residual films are moved closer to the both side walls of the transfer tank, and at the side wall portions, an action of holding the film by the film holding mechanism is cancelled, and from this cancelled portion, the divided liquid surface residual films are discharged out of the transfer tank.

The method for collecting a liquid surface residual film for liquid pressure transfer may be further configured such that the liquid surface residual film is divided using air blown to the liquid surface residual film on the surface of the transfer liquid.

The method for collecting a liquid surface residual film for liquid pressure transfer described above may be further configured such that when the divided liquid surface residual films are collected by the both side wall portions of the transfer tank, overflow tanks provided at both side wall portions are applied as discharge means, and the overflow tank includes blocking means, for blocking collection of the liquid, at a portion of a discharge port for collecting the liquid surface residual film, so that the liquid surface residual films are collected from portions before and after the blocking means.

The method for collecting a liquid surface residual film for liquid pressure transfer described above may be further configured such that the film holding mechanism is provided such that an end termination portion of the action of holding the film is arranged to somewhat overlap with the overflow tank for collecting the liquid surface residual film in a state of view from a side surface, so that a contact holding state of the mechanism for coming into contact with and holding the both sides of the film is maintained until the liquid surface residual film reaches the overflow tank.

The method for collecting a liquid surface residual film for liquid pressure transfer described above may be further configured such that at both right and left sides of the liquid-leaving area from which the object is removed out of the transfer liquid, a side oppositely-separating flow flowing from the liquid-leaving area to the both side walls of the transfer tank is formed in proximity to the surface of the liquid, and a foreign substance accumulated in the transfer liquid and on the surface of the liquid is moved away from the liquid-leaving area and discharged out of the transfer tank.

The method for collecting a liquid surface residual film for liquid pressure transfer described above may be further configured such that the side oppositely-separating flow is formed by overflow tanks provided at a stage subsequent to the overflow tanks for collecting the liquid surface residual film, and in a discharge port serving as a liquid collecting port of the overflow tank, a flow rate increase brim is formed to increase a flow rate of the transfer liquid introduced into the overflow tank.

The method for collecting a liquid surface residual film for liquid pressure transfer described above may be further configured such that in the liquid-leaving area, air is blow to push a bubble and a foreign substance generated on the surface of the liquid in the area to one of the side walls of the transfer tank, and together with the discharge of the foreign substance accumulated in the transfer liquid and on the surface of the liquid, the bubble and the foreign substance on the surface of the liquid in the area are also collected by the overflow tanks for forming the side oppositely-separating flow, so that the bubble and the foreign substance are discharged out of the tank.

The method for collecting a liquid surface residual film for liquid pressure transfer described above may be further configured such that at a downstream side of the liquid-leaving area, a design surface oppositely-separating flow, which flows from the design surface side of the object being pulled up from the transfer liquid to a further downstream side of the transfer tank, is formed in proximity to the surface of the liquid, and the bubble on the surface of the transfer liquid and the foreign substance accumulated in the liquid are moved away from the design surface of the object that is removed out of the liquid and are discharged out of the transfer tank.

The method for collecting a liquid surface residual film for liquid pressure transfer described above may be further configured such that the design surface oppositely-separating flow is formed by an overflow tank provided at the downstream side of the liquid-leaving area, and in a discharge port serving as a liquid collecting port of the overflow tank, a flow rate increase brim is formed to increase a flow rate of the transfer liquid introduced into the overflow tank.

The method for collecting a liquid surface residual film for liquid pressure transfer described above may be further configured such that the overflow tank for forming the design surface oppositely-separating flow is formed to be movable in a longitudinal direction of the transfer tank, and even when the position of the object is changed to a front or a back according to operation of removing the object out of the liquid, a substantially constant distance is maintained between the design surface of the object and the overflow tank.

The method for collecting a liquid surface residual film for liquid pressure transfer described above may be further configured such that the following elements are arranged to be movable in the longitudinal direction of the transfer tank: the end termination portion of the action of holding the film by the film holding mechanism; the dividing means for dividing the liquid surface residual film and the overflow tanks for collecting the liquid surface residual films divided; the overflow tanks for forming the side oppositely-separating flow in the liquid-leaving area and air blowing means for pushing the bubble and the foreign substance on the surface of the liquid in the liquid-leaving area to the overflow tanks; and the overflow tank for generating the design surface oppositely-separating flow.

The method for collecting a liquid surface residual film for liquid pressure transfer described above may be further configured such that the liquid pressure transfer applied to the object is performed by either applying a transfer film made by forming only a transfer pattern to a water-soluble film in a dried state and using a liquid curable resin composition as an activating agent, or applying a transfer film having a curable resin layer between a water-soluble film and a transfer pattern as a transfer film, and using the liquid pressure transfer, a transfer pattern also having a surface protection function is formed on the object, and this is cured by emission of active energy rays and/or heating after the transfer.

The method for collecting a liquid surface residual film for liquid pressure transfer described above may be further configured such that the object is conveyed substantially horizontally in a section from the immersion area to the liquid-leaving area in the transfer liquid.

A method for transferring liquid pressure may be configured such that in a method in which a transfer film made by forming at least a transfer pattern on a water-soluble film in a dried state is supported in a floating manner on a surface of a liquid in a transfer tank, and an object is pressed on the transfer film from above, whereby the transfer pattern is transferred onto the object, when collecting a liquid surface residual film not used for the transfer and floating on the surface of the transfer liquid after the object is immersed into the liquid, the liquid surface residual film is collected using the method for collecting the liquid surface residual film described above, and the liquid surface residual film is discharged out of the transfer tank.

The method for transferring liquid pressure described above may be further configured such that while the object is held by a manipulator, a series of conveyance from immersion into the liquid to removal from the liquid is performed, at a downstream side of the liquid-leaving area, an overflow tank is provided to form a design surface oppositely-separating flow which flows from the design surface side of the object being pulled up from the transfer liquid to a further downstream side of the transfer tank, and when the object is pulled up from the transfer liquid, the object is pulled up while a substantially constant distance is maintained between the design surface and the overflow tank by moving the object held by the manipulator to a front and a back and rotating the object held by the manipulator, in accordance with, e.g., a state of curve and a degree of projection and depression of the design surface.

The method for transferring liquid pressure described above may be further configured such that when the object has an opening portion in the design surface, the liquid pressure transfer is performed by arranging a thin film derivative on a back side of the opening portion, so that a thin film made of a water-dissolved material of the water-soluble film is formed on the back side of the opening portion.

A collecting device of a liquid surface residual film for a liquid pressure transfer may be configured such that the collecting device is provided in a device including a processing tank for storing a transfer liquid, a transfer film supply device for supplying a transfer film to this processing tank; and an object conveying device for pressing an object from above to the transfer film, in an activated state, on a surface of the liquid of the processing tank, wherein the transfer film made by forming at least a transfer pattern on a water-soluble film in a dried state is supported in a floating manner on the surface of the liquid in the processing tank, and the object is pressed on the transfer film from above, whereby the transfer pattern is transferred onto the object using a liquid pressure generated thereby, and the collecting device collects the liquid surface residual film not used for the transfer and floating on the surface of the liquid after the object is immersed into the transfer liquid, and wherein in the object conveying device, a conveying orbit is formed to pull up the object from a liquid-leaving area that is different from an immersion area, and the processing tank includes a film holding mechanism, provided at inner sides of both right and left side walls, for coming into contact with and holding both sides of the transfer film supplied to the processing tank and conveying the transfer film to at least the immersion area where the transfer is performed, wherein the processing tank includes dividing means for dividing the liquid surface residual film so as to split the liquid surface residual film in a longitudinal direction of the processing tank from when the object is immersed into the transfer liquid to when the object is removed from the transfer liquid, and the divided liquid surface residual films are moved closer to the both side walls of the processing tank, and includes discharge means for thereafter collecting, from the processing tank, the divided liquid surface residual films moved to both side walls of the processing tank, and wherein during collection, at the side wall portions of the processing tank to which the divided liquid surface residual films are moved, an action of holding the film by the film holding mechanism is cancelled, and the discharge means collects the divided liquid surface residual films from the both side wall portions of the processing tank.

The collecting device of a liquid surface residual film for liquid pressure transfer described above may be further configured such that an air blowing device is applied to the dividing means, and the liquid surface residual film is divided by blowing air.

The collecting device of a liquid surface residual film for liquid pressure transfer described above may be further configured such that overflow tanks provided at both side wall portions of the processing tank are applied to the discharge means, and the overflow tank includes blocking means, for blocking collection of the liquid is provided, at a portion of a discharge port for collecting the liquid surface residual film, so that the liquid surface residual films are collected from portions before and after the blocking means.

The collecting device of a liquid surface residual film for liquid pressure transfer described above may be further configured such that the film holding mechanism is provided such that an end termination portion of the action of holding the film is arranged to somewhat overlap with the overflow tank for collecting the liquid surface residual film in a state of view from a side surface, so that a contact holding state of the mechanism for coming into contact with and holding the both sides of the film is maintained until the liquid surface residual film reaches the overflow tank.

The collecting device of a liquid surface residual film for liquid pressure transfer described above may be further configured such that at both right and left sides of the liquid-leaving area from which the object is removed out of the transfer liquid, discharge means for collecting the transfer liquid in proximity to the surface of the liquid, and a side oppositely-separating flow flowing from the liquid-leaving area to the both side walls of the processing tank is formed by the discharge means, so that a foreign substance accumulated in the transfer liquid and on the surface of the liquid is moved away from the liquid-leaving area and discharged out of the transfer tank.

The collecting device of a liquid surface residual film for liquid pressure transfer described above may be further configured such that overflow tanks provided at a stage subsequent to the overflow tanks for collecting the liquid surface residual film is applied to the discharge means for forming the side oppositely-separating flow, and in a discharge port serving as a liquid collecting port of the overflow tank, a flow rate increase brim is formed to increase a flow rate of the transfer liquid introduced into the overflow tank.

The collecting device of a liquid surface residual film for liquid pressure transfer described above may be further configured such that in the processing tank, an air blowing device is provided to push a bubble and a foreign substance generated on the surface of the liquid in the liquid-leaving area to one of the side walls of the processing tank, and together with the discharge of the foreign substance accumulated in the transfer liquid and on the surface of the liquid, the bubble and the foreign substance on the surface of the liquid in the area are also discharged out of the tank from the overflow tanks for forming the side oppositely-separating flow.

The collecting device of a liquid surface residual film for liquid pressure transfer described above may be further configured such that at a downstream side of the liquid-leaving area, oppositely-separating flow forming means is provided to form a design surface oppositely-separating flow, which flows from the design surface side of the object pulled up from the transfer liquid to a further downstream side of the processing tank, and the bubble on the surface of the transfer liquid and the foreign substance accumulated in the liquid are moved away from the design surface of the object that is removed out of the liquid and are discharged out of the transfer tank.

The collecting device of a liquid surface residual film for liquid pressure transfer described above may be further configured such that an overflow tank provided at the downstream side of the liquid-leaving area is applied to the oppositely-separating flow forming means, and in a discharge port serving as a liquid collecting port of the overflow tank, a flow rate increase brim is formed to increase a flow rate of the transfer liquid introduced into the overflow tank.

The collecting device of a liquid surface residual film for liquid pressure transfer described above may be further configured such that the overflow tank serving as the oppositely-separating flow forming means is formed to be movable in a longitudinal direction of the processing tank, and even when the position of the object is changed to a front or a back according to operation of removing the object out of the liquid, a substantially constant distance is maintained between the design surface of the object and the overflow tank.

The collecting device of a liquid surface residual film for liquid pressure transfer described above may be further configured such that the following elements are arranged to be movable in the longitudinal direction of the processing tank: the end termination portion of the action of holding the film by the film holding mechanism; the air blowing device serving as the dividing means for dividing the liquid surface residual film and the overflow tanks for collecting the liquid surface residual films divided; the overflow tanks for forming the side oppositely-separating flow in the liquid-leaving area and the air blowing device for pushing the bubble and the foreign substance on the surface of the liquid in the liquid-leaving area to the overflow tanks; and the overflow tank for generating the design surface oppositely-separating flow.

The collecting device of a liquid surface residual film for liquid pressure transfer described above may be further configured such that the transfer film is either a transfer film made by forming only a transfer pattern to a water-soluble film in a dried state or a transfer film having a curable resin layer between a water-soluble film and a transfer pattern, and further when the film made by forming only the transfer pattern to the water-soluble film in the dried state is applied, a liquid curable resin composition is used as an activating agent, whereby during the liquid pressure transfer, a transfer pattern also having a surface protection function is formed on the object, and this is cured by emission of active energy rays and/or heating after the transfer.

The collecting device of a liquid surface residual film for liquid pressure transfer described above may be further configured such that the object conveying device has a conveying orbit in which the object in the transfer liquid is conveyed substantially horizontally from the immersion area to the liquid-leaving area.

A liquid pressure transfer device may include a processing tank for storing a transfer liquid a transfer film supply device for supplying a transfer film to this processing tank, and an object conveying device for pressing an object from above to the transfer film, in an activated state, on a surface of the liquid of the processing tank, wherein the transfer film made by forming at least a transfer pattern on a water-soluble film in a dried state is supported in a floating manner on the surface of the liquid in the processing tank, and the object is pressed on the transfer film from above, whereby the transfer pattern is transferred onto the object using a liquid pressure generated thereby, and the liquid pressure transfer device comprises the collecting device according to the embodiments described above, and wherein the collecting device collects a liquid surface residual film not used for the transfer and floating on the surface of the liquid after the object is immersed into the transfer liquid, and discharges the liquid surface residual film out of the processing tank.

The liquid pressure transfer device described above may be further configured such that a manipulator is applied to the object conveying device, and the manipulator performs a series of conveyance from when the object is immersed into the liquid to when the object is removed out of the liquid, at a downstream side of the liquid-leaving area, overflow tanks are provided as oppositely-separating flow forming means to form a design surface oppositely-separating flow which flows, due to the overflow tanks, from the design surface side of the object pulled up from the transfer liquid to a further downstream side of the transfer tank, when the object is pulled up from the transfer liquid, the object is pulled up while a substantially constant distance is maintained between the design surface and the overflow tank by moving the object held by the manipulator to a front and a back and rotating the object held by the manipulator, in accordance with, e.g., a state of curve and a degree of projection and depression of the design surface.

The liquid pressure transfer device described above may be further configured such that when the object has an opening portion in the design surface, the liquid pressure transfer is performed by arranging a thin film derivative on a back side of the opening portion, so that a thin film made of a water-dissolved material of the water-soluble film is formed on the back side of the opening portion.

Advantageous Effects of Invention

The constitution of the invention described in each claim is used as means for solving the above problems.

First, according to specific embodiments of the invention described above, from when the object is immersed into the transfer liquid to when the object is removed from the transfer liquid, the liquid surface residual film is divided and is discharged (collected) from the transfer tank (collected). Therefore, after the transfer, the liquid surface residual film can be collected quickly and reliably. Accordingly, the liquid surface residual film does not reach the liquid-leaving area, and the liquid surface residual film can be prevented from being attached to the design surface of the objects which ascend successively from the transfer liquid.

In the present invention, the transferred liquid surface residual film is divided and collected, and therefore, the liquid surface residual film can be collected without deforming the transfer film before the transfer such as the transfer position. More specifically, for example, when the liquid surface residual film is tried to be collected without dividing it, the entire film including the film that has not yet been transferred may be pulled during the collecting process, and in such case, e.g., the film that has not yet been transferred is considered to be deformed.

According to specific embodiments of the invention described above, the liquid surface residual film is divided by blowing air (air blow), and the air blowing device itself serving as the dividing means does not directly come into contact with the transfer film, and therefore, this can reduce, e.g., deformation that is exerted on the transfer film at the transfer position. More specifically, for example, when a rod and the like fixed in a hanging manner from the upper side of the transfer tank is brought into direct contact with the liquid surface residual film to divide the transfer film, certain force (deformation) is usually caused in the transfer film at the transfer position, back from the dividing start point. In contrast, in the present invention, the transfer film is divided by non-contact air blow, and therefore, the chance of giving adverse effects on the transfer film at the transfer position is extremely low. It is to be understood that the non-contact means that split pieces of the divided transfer films and the like would not attach to the dividing means (rod), and therefore, it is not necessary to replace and clean the dividing means, and the maintenance of the entire apparatus is easy.

According to specific embodiments of the invention described above, the liquid surface residual films are collected by the overflow tanks, and the overflow tank is provided with blocking means for blocking the collecting of the liquid. Therefore, even in the same overflow tank, the liquid surface residual film can be collected at two stages before and after the blocking means, and the blocking means can also control the guiding flow rate of the collecting process. Therefore, the liquid surface residual film can be reliably collected without pulling the entire liquid surface residual film (without giving adverse effects on the transfer film at the transfer position).

According to specific embodiments of the invention described above, the film holding mechanism is provided such that the end termination portion of the action of holding the film somewhat overlaps with the overflow tank. Therefore, the divided liquid surface residual films are reliably held by the film holding mechanism until the divided liquid surface residual films reach the overflow tanks, and it is possible to substantially solve the adverse effects of pulling the transfer film at the transfer position.

According to specific embodiments of the invention described above, the side oppositely-separating flow is formed in the liquid-leaving area, and therefore, the liquid surface residual films are collected continuously and reliably, and in addition, the foreign substances such as the film residues accumulated in the transfer liquid and on the surface of the liquid and the bubbles generated on the surface of the liquid can be moved away from the liquid-leaving area using the side oppositely-separating flow, whereby the foreign substances can be discharged out of the tank from both sides. Therefore, in addition to the collecting of the liquid surface residual films, the liquid-leaving area can be further cleaned and purified.

According to specific embodiments of the invention described above, the side oppositely-separating flow is formed by the overflow tanks, and the overflow tank is formed with the brim for increasing the flow rate. Therefore, mainly in the liquid-leaving area, for example, the bubbles on the surface of the liquid and the foreign substances floating in proximity to the surface of the liquid at the side of the decoration-unnecessary surface can be reliably collected.

According to specific embodiments of the invention described above, when the object is removed out of the liquid, many foreign substances such as bubbles and film residues generated on the surface of the liquid in the liquid-leaving area are pushed to one of the overflow tanks for the side oppositely-separating flow by conveying means using air blow. Therefore, the foreign substances can be reliably collected, and the foreign substances such as the bubbles and the film residues can be completely prevented from attaching to the object pulled up continuously from the transfer liquid.

It should be noted that the air blowing device for conveying the foreign substances and the bubbles on the surface of the liquid in the liquid-leaving area to the overflow tank for the side oppositely-separating flow may be provides separately from the air blowing device for dividing the liquid surface residual film, and if both actions can be performed with the same air blowing device, the same air blowing device may be commonly used.

According to specific embodiments of the invention described above, the design surface oppositely-separating flow flowing to further downstream side is formed for the side of the design surface in the liquid-leaving area, and therefore, with this oppositely-separating flow, the foreign substances and the bubbles in the transfer liquid and on the surface of the liquid can be moved away from the design surface of the object moving out of the liquid, and can be discharged out of the transfer tank. Therefore, the bubbles, the foreign substances, and the like generated at the rear side (downstream side, design surface side) with respect to the object pulled up in the liquid-leaving area can be continuously moved away from the object (design surface), and the cleaning and the purification of the liquid-leaving area can be further strengthened.

According to specific embodiments of the invention described above, the design surface oppositely-separating flow is formed by the overflow tanks, and the overflow tank is formed with the brim for increasing the flow rate. Therefore, mainly in the liquid-leaving area, for example, the bubbles on the surface of the liquid and the foreign substances floating in proximity to the surface of the liquid at the side of the design surface can be reliably collected.

According to specific embodiments of the invention described above, the overflow tanks for forming the design surface oppositely-separating flow are movable to the front and the back of the transfer tank (the upstream side and the downstream side), and even when the distance between the object and the overflow tank may change when the object is removed out of the liquid, the distance can be maintained substantially the same by moving the overflow tanks to the front and the back according to the movement of the position where the object is removed out of the liquid, and the bubbles and the foreign substances can be reliably collected.

According to specific embodiments of the invention described above, the film holding mechanism, the dividing means and the overflow tanks relating to collecting of the liquid surface residual film, the overflow tanks and the air blowing means relating to cleaning of the liquid-leaving area, the overflow tanks for forming the design surface oppositely-separating flow, and the like are movable in the longitudinal direction of the transfer tank. Therefore, according to the change of the position of the liquid-leaving area, the positions of these members can be adjusted appropriately. More specifically, in the liquid pressure transfer, various types of transfer films (transfer patterns) in various conditions are used, and activating agents and objects of different sizes are processed. Therefore, it is necessary to move the immersion area by, for example, 800 mm, and move the liquid-leaving area to the front or the back by about 800 mm to about 1200 mm in accordance with the movement. In the present invention, it is easy to move (change settings of) the members described above.

According to specific embodiments of the invention described above, the transfer pattern also having the surface protection function is formed on the object by the liquid pressure transfer, and this is cured by the emission of the active energy rays and/or heating thereafter. Therefore, it is important to avoid attaching the bubbles and the foreign substances such as film residues to the object pulled up from the transfer liquid, and such liquid pressure transfer (liquid pressure transfer for forming the transfer pattern also having the surface protection function) can be done with an extremely low defective rate.

According to specific embodiments of the invention described above, the object is conveyed substantially horizontally in the section from the immersion area to the liquid-leaving area in the transfer liquid. Therefore, the object can be conveyed and removed out of the liquid without causing great change in the speed and great change in the angle in the transfer liquid, and this brings an advantage in that it is less likely to cause deformation of the transfer pattern transferred onto the object as soon as the object is immersed into the liquid. On the contrary, in the conventional triangular, the conveying orbit is in an inverted triangle shape when it is seen from a side surface, and the object is immersed into the liquid and removed out of the liquid at the apex of this inverted triangle. Therefore, there is a great change in the speed and great change in the angle of the object at the apex (under the surface of the liquid), and this may cause deformation of the transfer pattern transferred onto the design surface.

According to specific embodiments of the invention described above, depending on, e.g., the state of the curve and the degree of projections and depressions of the design surface of the object, the object is moved as necessary, so that the object can be pulled up while maintaining a constant distance between the design surface and the overflow tank, and the bubbles and the foreign substances can be collected more reliably with the design surface oppositely-separating flow.

According to specific embodiments of the invention described above, when the object has the opening portion, the thin film derivative is provided at the back side of the opening portion, so that a rigid thin film can be formed at the portion with a narrow clearance (the thin film is not formed at the side of the design surface, and the thin film is less likely to burst), and the bubbles generated at the back side of the object are also blocked by the thin film derivative. Therefore, the bubbles can be prevented from attaching to the design surface, and the precise liquid pressure transfer can be performed.

DESCRIPTION OF EMBODIMENTS

Figure 1:
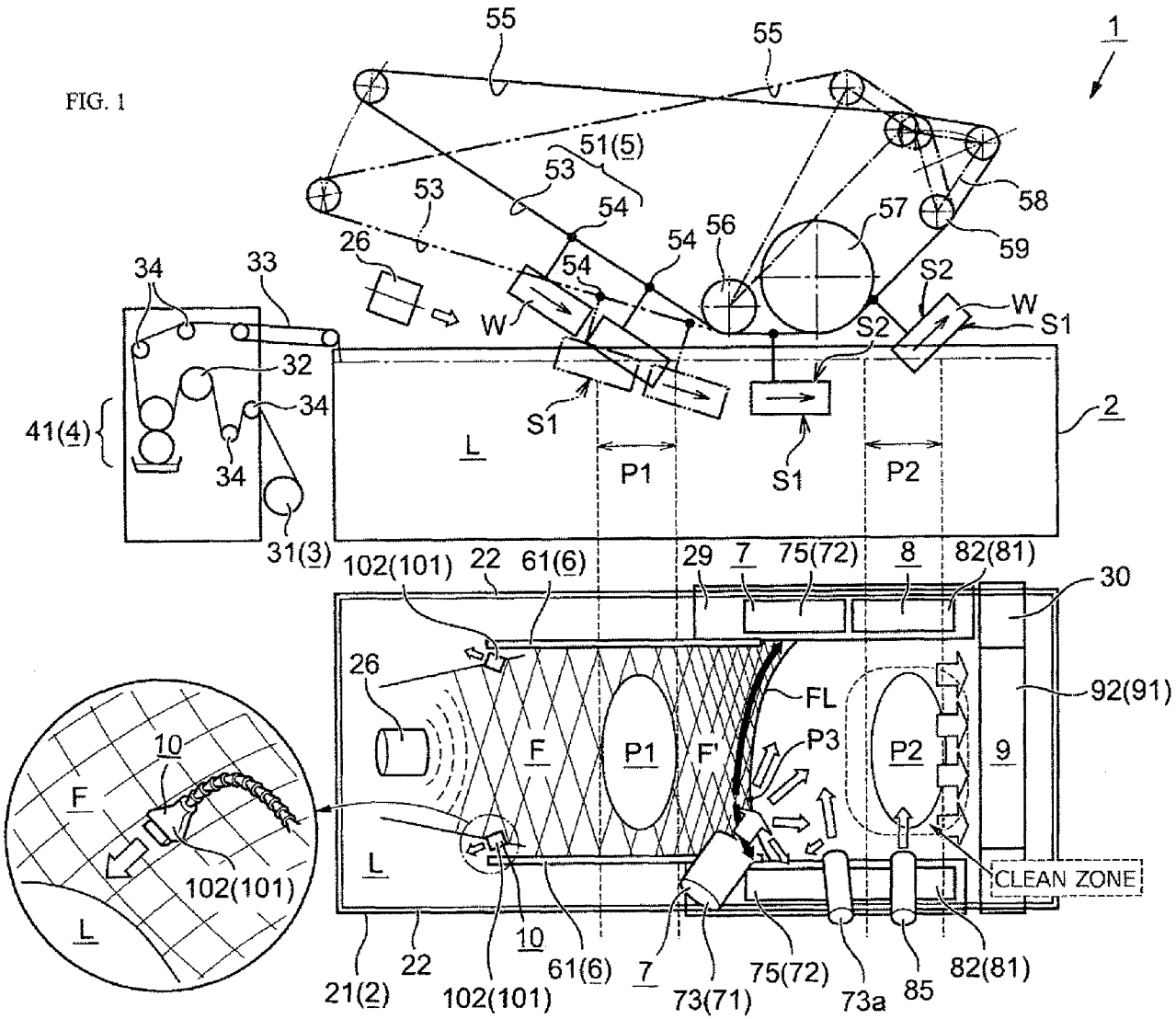
FIG. 1 is a top view and a sectional side view illustrating an example of a liquid pressure transfer device to which a collecting device for collecting a liquid surface residual film according to the present invention.

Modes for carrying out the present invention include an embodiment described below as one of such modes and further include various kinds of methods that can be achieved by making improvements within the technical scope thereof it should be noted that, in the explanation, first, a transfer film F preferably used in the present invention will be explained. Thereafter, while overall configuration of a liquid pressure transfer device 1 is explained, a transfer tank 2 substantially corresponding to a collecting device of a liquid surface residual film is also explained. Subsequently, while an aspect of operation of the liquid pressure transfer device is explained, a method for collecting a liquid surface residual film is also explained.

Embodiments

First, the transfer film F preferably used in the present invention will be explained. In the present invention, during liquid pressure transfer, only a transfer pattern is not simply transferred onto an object W, and it is preferable to transfer a transfer pattern also having a surface protection function (in this specification, such transfer pattern will be referred to as "transfer pattern also having surface protection function"). This is because a top coating, which was applied after the transfer in the past, is not needed. That is, in the liquid pressure transfer that also gives the surface protection function, the transfer pattern formed by the liquid pressure transfer is cured by emitting active energy rays such as ultraviolet rays and an electron beam to the object W to which the transfer pattern has been transferred, so that the surface can be protected. Nonetheless, it is also possible to further apply a top coating after the transfer pattern also having the surface protection function has been transferred.

Due to such facts, the transfer film F is preferably a film having only a transfer pattern made of transfer ink on a water-soluble film (for example, PVA (polyvinyl alcohol)) or a film having a curable resin layer formed between a water-soluble film and a transfer pattern. In particular, when the transfer film F having only the transfer pattern formed on the water-soluble film is used, a liquid curable resin composition is used as an activating agent. In this case, the curable resin composition is preferably a solvent-free ultraviolet or electron beam curable resin composition including photopolymerizable monomer.

It is to be understood that the collecting method of the present invention can also be applied even when a transfer film F having only a transfer pattern formed on a water-soluble film is used but the surface protection function is not given during the liquid pressure transfer and thereafter an ordinary top coating is applied to provide surface protection (conventional liquid pressure transfer method).

In this case, transfer patterns include various kinds of patterns such as a wood form pattern, a metallic (gloss) form pattern, a stone form pattern imitating a surface of a rock such as a marble form, a fabric form pattern imitating a grain and a fabric-like form, a pattern such as a tiling form and a brick-laying form, and a pattern having a geometric form and hologram effect. Further, the transfer pattern may be a pattern made by appropriately combining the above patterns. It should be noted that the above geometric form includes not only figures but also patterns having characters and pictures applied thereon.

Surfaces of the object W will be defined. First, a transfer surface having a decorative layer formed thereon is a design surface S1. This design surface S1 is a surface that requires a precise transfer, and is a surface facing the transfer film F (transfer pattern) floating on a transfer liquid surface when the object W is immersed into the liquid. In this case, as described above, when the transfer pattern also having the surface protection function is formed during the liquid pressure transfer, the design surface S1 of the object W is prevented, as much as possible, from being attached to a liquid surface residual film F', a redundant film, film residues, bubbles A, and the like.

On the other hand, a surface of the object W on which the decorative layer is not formed (surface that does not require any liquid pressure transfer) is a decoration-unnecessary surface S2. No problem would be caused when the film residues, the bubbles A, and the like attach to the decoration-unnecessary surface S2 (for example, no problem would be caused when the transfer pattern coming from the design surface S1 is transferred onto the decoration-unnecessary surface S2 in a distorted manner).

Therefore, in other words, the design surface S1 is a portion which is seen as an external appearance when the object W (liquid pressure transfer product) is ultimately made into a completed product assembled as an assembly and the like. The decoration-unnecessary surface S2 is a portion which is not seen as an external appearance in the assembled state, and is usually at the back side of the design surface S1.

Figure 2:
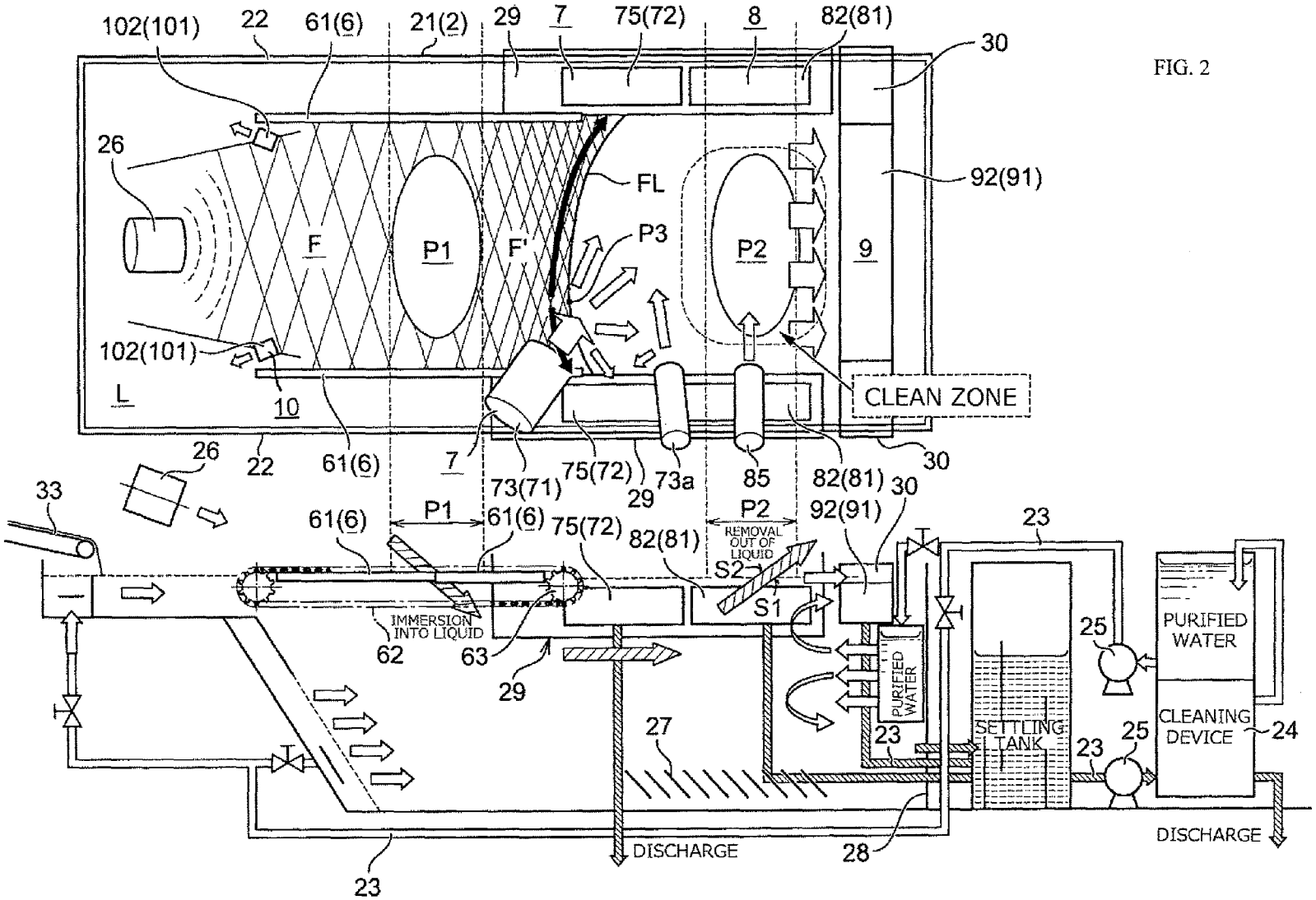
FIG. 2 is a sectional side view is the same as the above and also shows an internal structure of the transfer tank with respect to the top view.

Subsequently, the liquid pressure transfer device 1 will be explained. For example, as shown in FIGS. 1 and 2, the liquid pressure transfer device 1 includes a transfer tank 2 for storing the transfer liquid L, a transfer film supply device 3 for supplying the transfer film F to this transfer tank 2, an activating agent applying device 4 for activating the transfer film F thereby rendering the transfer film F in a transferrable state, and an object conveying device 5 for placing (immersing) the object W in an appropriate posture from the upper side of the transfer film F supported in a floating manner in the transfer tank 2 and removing (pulling out) the object W from the liquid.

In addition, the transfer tank 2 includes a film holding mechanism 6 for holding both sides of the transfer film F supplied onto the surface of the transfer liquid, a liquid surface residual film collecting mechanism 7 for collecting (discharging) the liquid surface residual film F', which is unnecessary after the object W is immersed, from the transfer tank 2, a liquid-leaving area cleaning mechanism 8 for mainly cleaning a liquid-leaving area (mainly the decoration-unnecessary surface S2 of the object W that comes out of the liquid (side opposite to the design surface S1)), a design surface cleaning mechanism 9 for cleaning the design surface S1 of the object W that ascends in the liquid-leaving area, and an elongation and extension reduction prevention mechanism 10 for preventing reduction of elongation and extension of the transfer film F that is supplied onto the surface of the transfer liquid L, by removing an activating agent component K leaving the transfer film F coming into contact with the liquid and flowing onto the surface of the transfer liquid. Hereinafter, each constituent unit will be explained.

First, the transfer tank 2 will be explained. The transfer tank 2 is a portion where the transfer film F is supported in a floating manner when the liquid pressure transfer is performed. The transfer tank 2 includes, as a main constituent unit member, processing tank 21 that can store the transfer liquid L at a substantially constant liquid level (water level). For this reason, the upper side of the processing tank 21 is open. The processing tank 21 has a shape having a bottom enclosed by sidewalls in the front, the rear, the right, and the left of the processing tank 21. In particular, reference numeral 22 is given to both side walls constituting both right and left sides of the processing tank 21. In this case, a position of the processing tank 21 where the processed object W is immersed into the transfer liquid L (inlet position) is referred to as an immersion area P1, and a position of the processing tank 21 where the processed object W is pulled out of the transfer liquid L (outlet position) is referred to as a liquid-leaving area P2. It should be noted that, in the liquid pressure transfer, the transfer is executed and completed as soon as the object W is immersed, and therefore, the immersion area P1 may also be called a transfer position (transfer area). The reason why the term "area" is mainly used in the above naming is that, depending on the type and the condition of the transfer pattern of the transfer film F, the transfer position is usually moved to the front or the rear and the transfer film F (transfer pattern) is transferred onto the design surface S1 having a certain size of area, and this means that, in many cases, the object W is immersed into the liquid and removed from the liquid with a certain angle with respect to the surface of the liquid (with a certain range or size of area).

Further, in the present invention, while the object W is immersed into the transfer liquid L, a film remaining on the surface of the liquid (unnecessary liquid surface residual film F' that is not used for the transfer) is divided in the longitudinal direction of the transfer tank 2 (the direction of the flow of the liquid), and therefore, the interval between the immersion area P1 and the liquid-leaving area P2 is preferably spaced apart by a certain distance. It should be noted that the liquid surface residual film F' that is divided in the longitudinal direction of the transfer tank 2 is thereafter moved (conveyed) to the both side walls 22 of the transfer tank 2, and the liquid surface residual film F' is discharged (collected) from the both side walls 22 to the outside of the transfer tank 2.

In the processing tank 21, a flow of the liquid, in which the transfer liquid L is conveyed from the film supply side (upstream side) to the liquid-leaving area P2 (downstream side), is formed in a portion of the surface of the liquid. More specifically, overflow tanks (overflow tanks 82, 92 and the like explained later) are provided in proximity to a downstream end of the transfer tank 2, and the transfer liquid L collected in the overflow tanks is circulated and supplied via a circulating pipe path 23 to mainly an upstream portion of the transfer tank 2, so that the flow of the liquid is formed in proximity to the surface of the transfer liquid L. It is to be understood that this circulating pipe path 23 is preferably provided with a cleaning device 24 such as a sedimentation tank and filtering, and foreign substances such as the redundant film and the film residue dispersed and accumulated in the transfer liquid L are preferably removed from the collected liquid (suspension) and then the collected liquid is provided for reuse.

Inside of the both side walls 22 of the processing tank 21, chain conveyers 61 serving as the film holding mechanism 6 are provided, and the chain conveyers 61 hold both sides of the transfer film F supplied to the surface of the liquid, so that the transfer film F is conveyed from the upstream side to the downstream side at a speed synchronized with the flow of the transfer liquid L. It is to be understood that the transfer film F supplied onto the surface of the transfer liquid (in particular, water-soluble film) gradually proceeds (extends) in all directions after the transfer film F comes into contact with the liquid, and therefore, the film holding mechanism 6 (the chain conveyers 61) also performs an action of restricting the extension of this film from both sides. In other words, the film holding mechanism 6 (the chain conveyers 61) performs an action of conveying the transfer film F to at least the immersion area P1 (transfer position) while the extension of the transfer film F is maintained at a substantially constant level. Therefore, at the transfer position, the extension of the transfer film F is maintained at the same level on every occasion, and precise transfer can be performed continuously.

As described above, the film holding mechanism 6 (the chain conveyers 61) not only performs an action of simply conveying the transfer film F but also performs an action of maintaining the extension of the film at the transfer position to a constant level (performs an action of restricting the extension). In this specification, they are collectively referred to as "the action of holding the film". By the way, in the present invention, this action of holding the film is released at a portion where the liquid surface residual film F' is collected, the details of which will be explained later.

In this case, the chain conveyer 61 includes a chain 62 and a sprocket 63 around which the chain 62 is wound, and when rotation is input from a motor and the like to the sprocket 63 as necessary, the chains 62 are driven at substantially the same speed as the flow of the liquid. Then, a normal orbit of the chain 62 at the upper side is set so that the center of the chain 62 matches the level of the surface of the liquid. Accordingly, the uppermost surface of the chain 62 at the upper side appears in a space slightly above the level of the surface of the liquid, and therefore, the chains 62 come into contact with both sides of the transfer film F on the surface of the liquid in a relatively rigid manner, and thus, the film is held. Due to such configuration, portions of the both sides of the transfer film F coming into contact with the chains 62 are usually in a streak form.

It should be noted that the film holding mechanism 6 may be not only the chain conveyors 61 but also, e.g., a conveyor belt and relatively thick wires and ropes.

An air blowing device 26 is provided above the film supply side (upstream side) of the processing tank 21, and this uniformly extends the transfer film F to portions around the transfer film F and helps the transfer film F proceed to the downstream side.

In this case, blowing of the air blowing device 26 is greatly characterized in that the air blowing device 26 causes air to directly act on (directly blows air to) the transfer film F. In other words, the air blowing device 26 is a method for blowing air to the transfer film F itself, and this is a concept of pressing and forcibly extending (elongating) the transfer film F to portions therearound by the force of the air.

Since the air blowing device 26 performs the action of conveying the transfer film F to the downstream side in an auxiliary manner, the air blowing direction thereof is solely one direction from the upstream side to the downstream side. It is to be understood that the attachment position of the air blowing device 26 is also set at the central position (center in the width direction) of the transfer tank 2.

Further, since the air blowing device 26 causes the air to directly act on the transfer film F, the amount of air blow is set at a relatively strong level (a relatively high level), and accordingly, it is considered that the wave caused by the air blow affects even the transfer position (immersion area P1). Therefore, in order to prevent this, it is preferable to provide a wave cancellation plate and the like between the air blowing device 26 and the transfer position in the transfer tank 2, so as to stabilize the surface of the transfer liquid, and in particular, stabilize the surface of the liquid at the transfer position.

Subsequently, the liquid surface residual film collecting mechanism 7 will be explained. The liquid surface residual film collecting mechanism 7 is a mechanism for collecting the liquid surface residual film F' remaining on the surface of the transfer liquid L after the object W is immersed, so that the liquid surface residual film F' does not reach the liquid-leaving area P2. In other words, when the object W is immersed, the transfer film F is in a pierced state (in this case, a state in which an elongated hole is formed) as shown in FIG. 1, for example, and the pierced portion is mainly a portion that sinks into the liquid together with the object W and that is attached and transferred to the design surface S1 due to the pressure of the liquid thereof. However, the film remaining on the surface of the liquid (film floating with an opening formed therein) is not used for transfer, and is an unnecessary portion (this is the liquid surface residual film F'). When such liquid surface residual film F' is left as it is, it may be a factor to contaminate the transfer liquid L, and when the liquid surface residual film F' reaches the liquid-leaving area P2 downstream, it attaches to the object W pulled up from the transfer liquid (design surface S1). Therefore, in the present invention, the liquid surface residual film F' is reliably collected as soon as the transfer is completed. More specifically, first, the liquid surface residual film F' is divided in the longitudinal direction of the transfer tank 2, i.e., the direction of the flow of the liquid, and they are moved (pressed) to the both side walls 22 of the transfer tank 2, so that the divided liquid surface residual films F' are discharged from the both side walls 22 to the outside of the tank.

Therefore, the liquid surface residual film collecting mechanism 7 includes dividing means 71 for splitting and dividing the liquid surface residual film F' in the direction of the flow of the liquid and discharge means 72 for discharging the liquid surface residual film F' at the portions of the side walls 22 of the transfer tank 2 to the outside of the tank. The dividing means 71 and the discharge means 72 will be hereinafter explained.

First, the dividing means 71 will be explained. After the object W is immersed, i.e., after the transfer, the dividing means 71 quickly divides the liquid surface residual film F' (causes the liquid surface residual film F' to branch off), and in this case, a method of blowing air is employed so as to reliably divide the liquid surface residual film F' without coming into contact with the film. More specifically, for example, as shown in FIG. 1, the air blowing device 73 is provided on one of the side walls 22 of the processing tank 21, and air is blown from the air blowing device 73 to the liquid surface residual film F' on the surface of the liquid. In this case, it is simply described as the "air blowing device (73)" in the above explanation, but this term includes extension ducts, nozzles, and the like connected to the air blowing device.

Although the liquid surface residual film F' is divided quickly in the above explanation, the transfer itself cannot be performed accurately if the action of dividing the dividing means 71 (in this case, the amount of air blow) gives adverse effects such as deformation (distortion of pattern caused by returning wave and the like) and stress to the transfer film F at the transfer position (immersion area P1). The range acted on by the action of the dividing means 71 is set so as not to give adverse effects on the transfer position (for example, with a certain distance). In other words, the amount of air blow (the force of air blow) of the air blowing device 73 serving as the dividing means 71 is set at a relatively low level so as not to give adverse effects on the transfer position. Therefore, the position where the air blowing device 73 serving as the dividing means 71 is preferably, flexibly movable in the longitudinal direction of the transfer tank 2 in accordance with the reciprocal movement of the transfer position. As a result, the position can be set easily at an appropriate position where the action of dividing is achieved without giving adverse effects on the transfer position.

In this case, the situation of dividing of the liquid surface residual film F' by the air blowing device 73 will be explained. The liquid surface residual film F' is divided into the right and left by the air blow by the air blowing device 73, and in particular, a start point from which the liquid surface residual film F' is divided will be referred to as a dividing start point P3. The liquid surface residual film F' is divided to a substantially arch shape or a substantially V shape by the air blown from the dividing start point P3, and it appears as if it is a line, and therefore, this film separation line is defined as a dividing line FL. It is to be understood that portions around edges of the dividing line FL are gradually dissolved little by little and separated, and move closer to the both side walls 22 by the blown air and the flow of the liquid. Therefore, in FIG. 3, the dividing line FL is drawn as a clear solid line in proximity to the dividing start point P3, but it is drawn as a broken line in portions of the side walls 22 away from there.

It should be noted that, in the present embodiment, at first glance, it appears that there is no member for performing an action of moving the divided liquid surface residual film F' to both side walls 22, but the air blowing device 73 serving as the dividing means 71 performs an action of moving the divided liquid surface residual film F' to the side walls 22. It is to be understood that the flow of the liquid formed in the transfer tank 2 also helps this action.

In the present embodiment, the air blowing device 73 serving as the dividing means 71 is provided on one of the side walls 22, and the liquid surface residual film F' is divided into two parts. Therefore, for example, the ratio of division into both side walls 22 is about 8:2 to 7:3. It is to be understood that the right and left side walls 22 can be divided substantially equally when the liquid surface residual film F is divided, but in this case, it is considered to be common to provide the dividing means 71 (air blowing device 73) in the center in the width direction of the transfer tank 2, and it is necessary to consider the aspect of installation with regard to the object conveying device 5 located in the center of the width direction of the transfer tank 2.

It should be noted that only one air blowing device 73 serving as the dividing means 71 may not be provided. Alternatively, two air blowing devices 73 serving as the dividing means 71 can be provided in combination. As described above, this can be said countermeasure for inability to forcibly increase the amount of air blow (make the air blow stronger) of the air blowing device 73. More specifically, for example, as also shown in FIG. 1, a still smaller auxiliary air blowing device 73*a* is installed at the side wall 22 arranged with the air blowing device 73, so that the liquid surface residual film F' is reliably pushed to a side at which more film can be collected.

Figure 4:
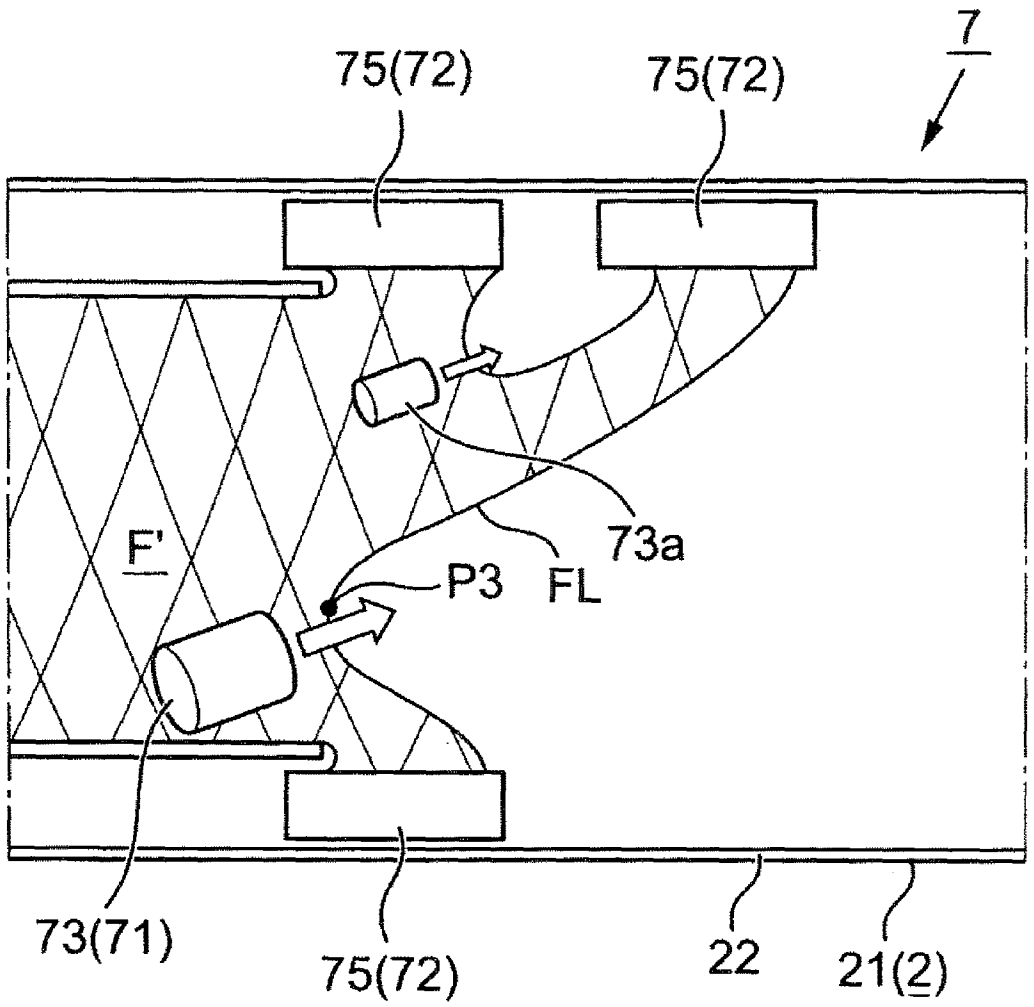
FIG. 4 is a top view illustrating a transfer tank in which two air blowing devices are used as dividing means, and a liquid surface residual film is divided into three parts in a direction of flow of a liquid, so that the divided liquid surface residual films are collected at three locations.

It is to be understood that the direction in which the air is blown by the auxiliary air blowing device 73*a* is not necessarily limited to the aspect of FIG. 1. For example, as shown in FIG. 4, the direction in which the air is blown by the auxiliary air blowing device 73*a* may be set substantially in the same direction as the direction in which the air is blown by the main air blowing device 73. It should be noted that in this embodiment of FIG. 4, the liquid surface residual film F' is divided into three parts as a result, and are collected at three places. Therefore, it can be said that this indicates that, in the present embodiment, the aspect of dividing of the liquid surface residual film F' is not be necessarily limited to division into two parts (may not be necessarily collected at two places). In other words, various kinds of dividing forms and collecting forms can be employed depending on the situation of dividing/collecting and the aspect of the transfer film F.

Figure 5:
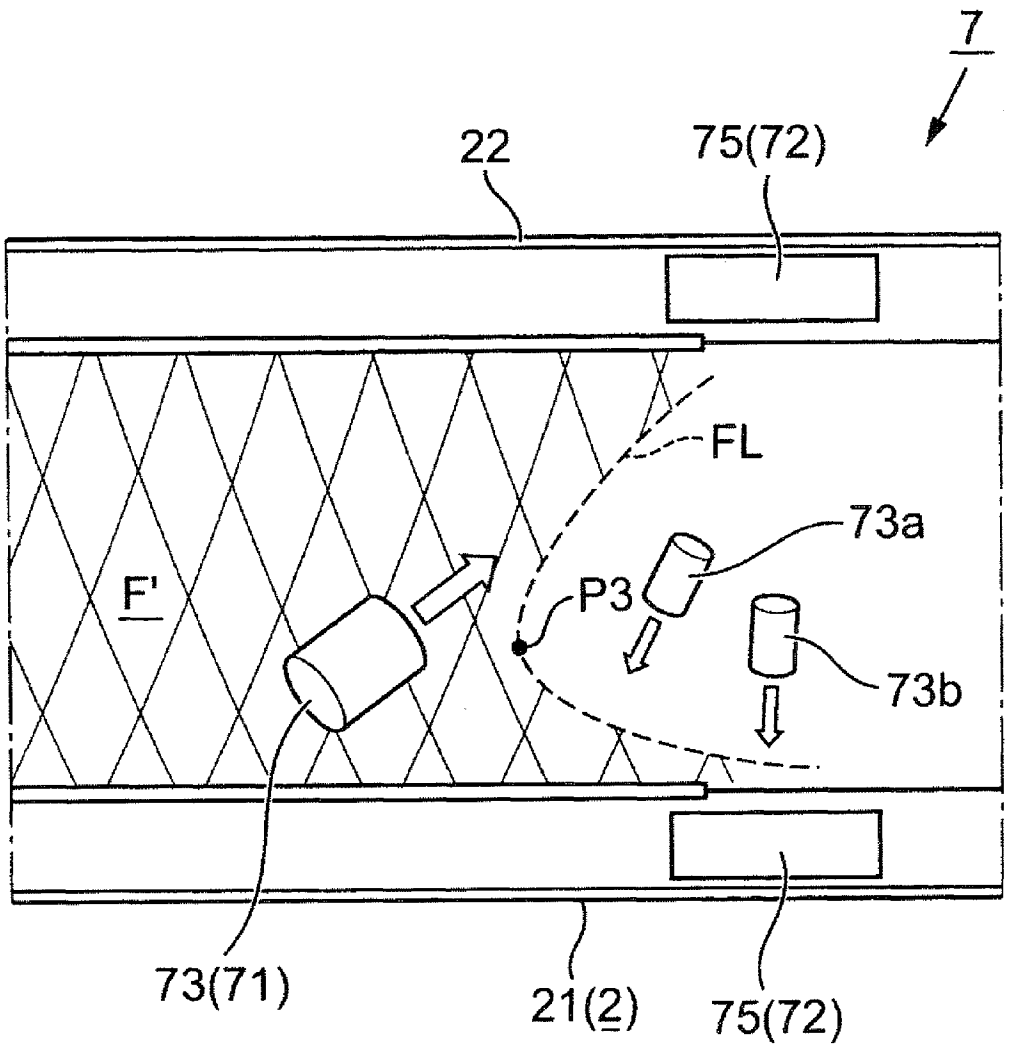
FIG. 5 is a top view illustrating a transfer tank in which three air blowing devices are used as dividing means, and a liquid surface residual film is divided into two parts in the direction of the flow of the liquid.

Further, for example, FIG. 5 shows an embodiment in which three air blowing devices (the main air blowing device is denoted with 73, and the auxiliary air blowing devices are denoted with 73*a*, 73*b*) are provided as the dividing means 71, and has such a concept that since the amount of air blow of the auxiliary air blowing device 73*a* is weak (it is difficult to increase the amount of air blow of the auxiliary air blowing device 73*a*), another auxiliary air blowing device 73*b* is used to reliably push one of the divided liquid surface residual films F' in a lateral direction at last.

It should be noted that the above method for dividing the liquid surface residual film F' by blowing air achieves the effect of being able to divide the liquid surface residual film F' in a non-contact state (i.e., the liquid surface residual film F' can be divided without bringing the air blowing device 73 itself into direct contact with the film and the effect of not giving adverse effects such as deformation to the transfer film F at the transfer position.

Subsequently, the discharge means 72 in the liquid surface residual film collecting mechanism 7 will be explained. The discharge means 72 collects the liquid surface residual films F' pressed to the side walls 22 of the transfer tank 2, and discharges the liquid surface residual films F' to the outside of the transfer tank 2. In the present embodiment, overflow tanks 75 provided inside of the both right and left side walls 22 of the processing tank 21 is applied. In this case, in the overflow tank 75, collecting ports for introducing the liquid surface residual films F' together with the transfer liquid L are referred to as discharge ports 76.

In addition, since this kind of discharge structure using overflow is employed, the action of holding the film achieved with the film holding mechanism 6 (in this case, chain conveyer 61) is cancelled in the discharge ports 76 as described above, and this makes it easy to discharge (collect) the liquid surface residual film F' pressed to the both side walls 22. On the contrary, when the chains 62 run at the discharge ports 76 of the overflow tank 75, the chains 62 block the discharge ports 76, and prevents discharge of the liquid surface residual films F', and therefore, the action of holding the film is cancelled in the portions of the discharge ports 76 in the present invention.

Specific method for cancellation will be explained. In the present embodiment, for example as shown in FIG. 2, sprockets 63 serving as end termination portions of the action of holding the films are provided in proximity to the dividing start point P3 when seen from the side surface, and the chain conveyers 61 (chains 62) are folded back at the sprockets 63. In this kind of aspect of arrangement, in the portions of the discharge ports 76 of the overflow tank 75, the action of holding the films by the film holding mechanism 6 (chain conveyer 61) is cancelled.

However, the chain conveyers 61 are preferably overlap with the overflow tank 75 (the portions of the discharge ports 76) to some extent when seen from the side surface, i.e., the sprockets 63 serving as the end termination portions of the action of holding the film are preferably arranged to overlap with the overflow tank 75 to some extent when seen from the side surface, which will be explained later.

Figure 6:
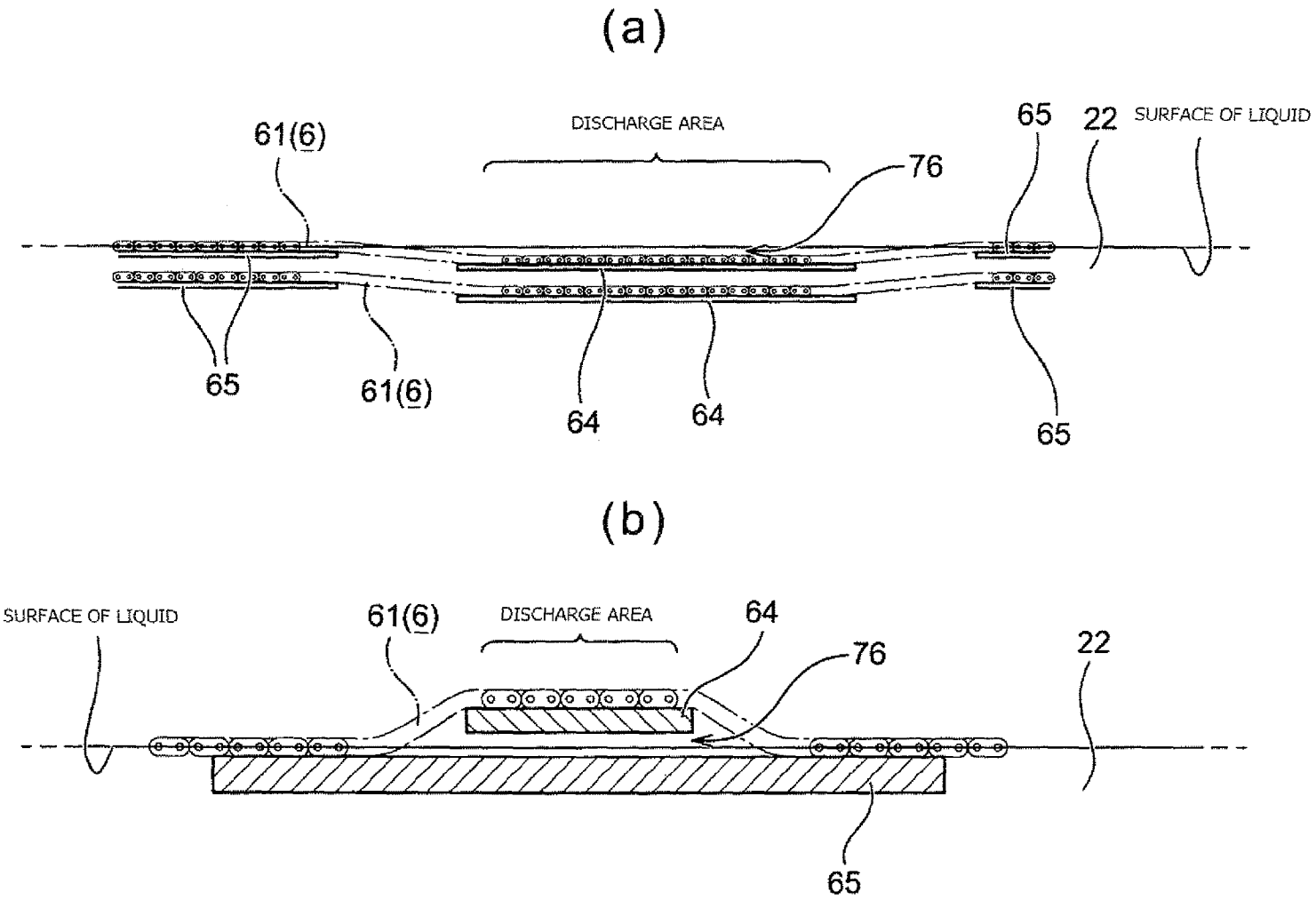
FIG. 6 is an explanatory diagram (diagram of a film holding mechanism when it is seen from a side surface) illustrating another embodiment in which the divided liquid surface residual films are moved to side wall portions of the transfer tank, and when the divided liquid surface residual films are discharged from there, an action of holding the film by the film holding mechanism is cancelled.

Methods other than the above may also be employed to cancel the action of holding the film by the chain conveyers 61 at the portions of the discharge ports 76. In other words, as described above, usually, the chain conveyers 61 are set so that the center of the chain 62 at the upper side matches the level of the surface of the liquid in the state of view from the side surface. For example, as shown in FIG. 6(*a*), in proximity to the discharge port 76, the chain conveyers 61 are dropped to a level below the surface of the liquid, and at these portions, the action of holding the film can be cancelled. Alternatively, on the contrary, as shown in FIG. 6(*b*), the action of holding the film can be cancelled by raising the chain conveyers 61 to a space above the surface of the liquid in proximity to the discharge ports 76. In this case, in the figure, reference numeral 64 denotes a guide body for restricting the upper side or the lower side of the chain conveyer 61 so that the chain 62 does not block the discharge port 76 in proximity to the discharge port 76, and further, in the figure, reference numeral 65 denotes a guide body for guiding the chain conveyers 61 at an ordinary height (orbit).

Figure 3:
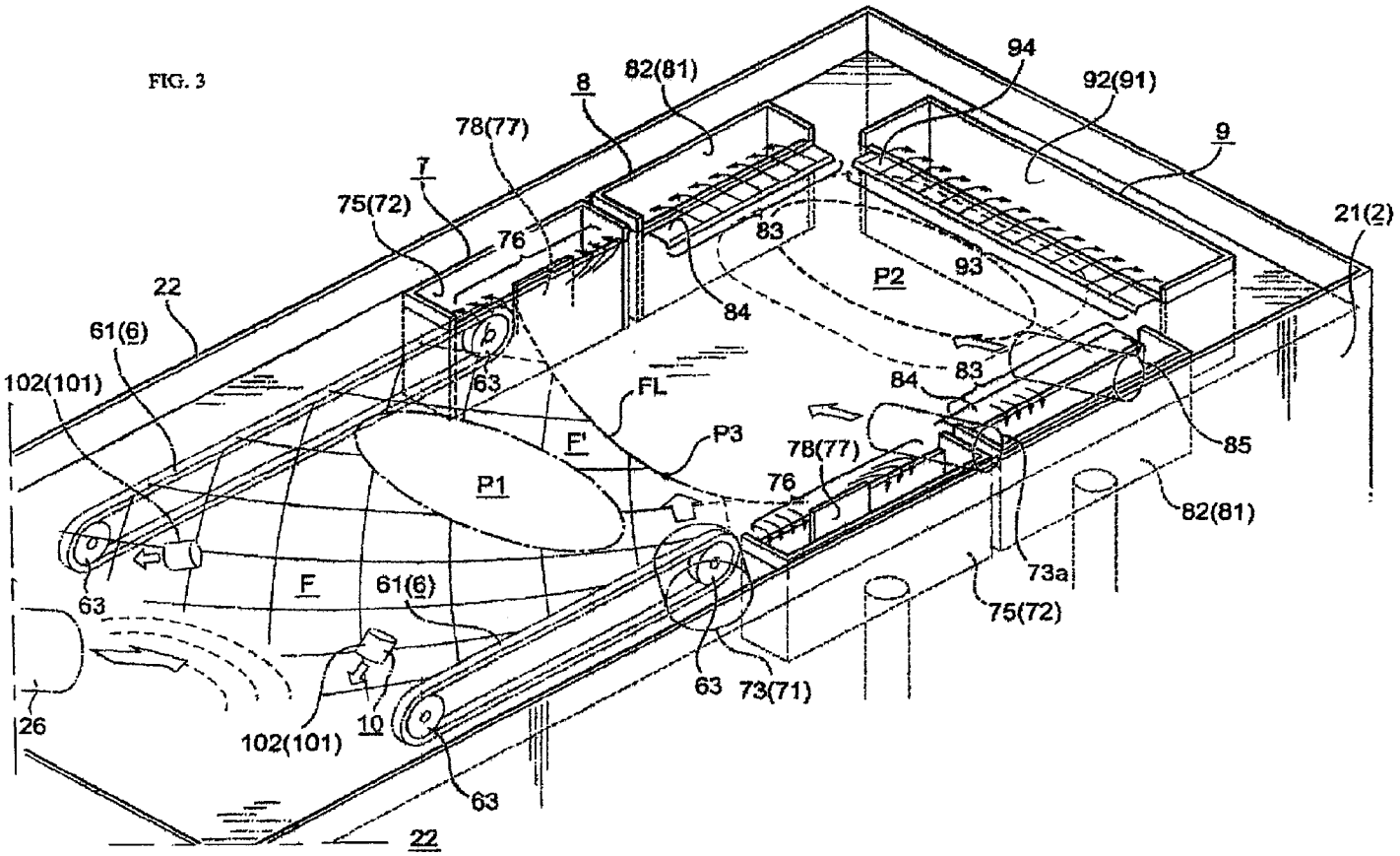
FIG. 3 is a structural perspective view illustrating the transfer tank.

For example, as shown in FIG. 3, the overflow tank 75 according to the present embodiment has a screen board 78 in a part of the discharge port 76, wherein the screen board 78 serves as blocking means 77 to block the collection of the liquid, and this is a configuration intended to collect the liquid surface residual film F' at two stages before and after the blocking means 77 (screen board 78) even in the one overflow tank 75. The blocking means 77 narrows the flow rate guiding range of the discharge port 76, and accordingly, performs control so as to reduce the flow rate after the action of holding the film is cancelled. In addition, this allows the liquid surface residual films F' to be reliably collected without adversely affecting the transfer position (immersion area P1).

By the way, when the liquid surface residual films F' are introduced into the overflow tank 75 from the entire discharge port 76 without providing the blocking means 77 in the discharge port 76, the liquid surface residual films F' moving closer to the side walls 22 are pulled in the whole, and the applicant of the present application has confirmed that this extends to the transfer position and gives adverse effects such as deformation to the transfer position.

The transfer liquid L collected in the overflow tanks 75 includes a large amount of liquid surface residual films F', i.e., transfer patterns (ink components) and half-dissolved water-soluble films, and the degree of contamination of foreign substances is high. Therefore, the transfer liquid L collected in the overflow tanks 75 is preferably discarded as it is, but the transfer liquid L collected in the overflow tanks 75 may also be provided for recycled use after a cleaning device 24 such as filtering removes the foreign substances.

The overflow tanks 75 are fixed to the side walls 22 (frame) of the transfer tank 2 using bolts and the like, in the front and back direction, i.e., the direction of the flow of the liquid, so that the overall height of the overflow tank 75 can be changed, and it is preferable to attach the overflow tanks 75 so that the inclination of the overflow tanks 75 themselves in the front and back direction can be adjusted. Like the air blowing device 73, the entire overflow tank 75 is preferably, flexibly movable to the front and back in the longitudinal direction of the transfer tank 2 in view of the change of the transfer position. Further, the arrangement position of the blocking means 77 with respect to the discharge port 76 is also preferably configured to be changed as necessary, and the width (the length in the front and back direction) thereof is also preferably configured to be changed as necessary.

Now, the reason (details) why the film holding mechanism 6 (chain conveyer 61) preferably overlaps with the overflow tank 75 (the portions of the discharge ports 76) to some extent in the state of view from the side surface will be explained on the basis of FIG. 7.

Figure 7:
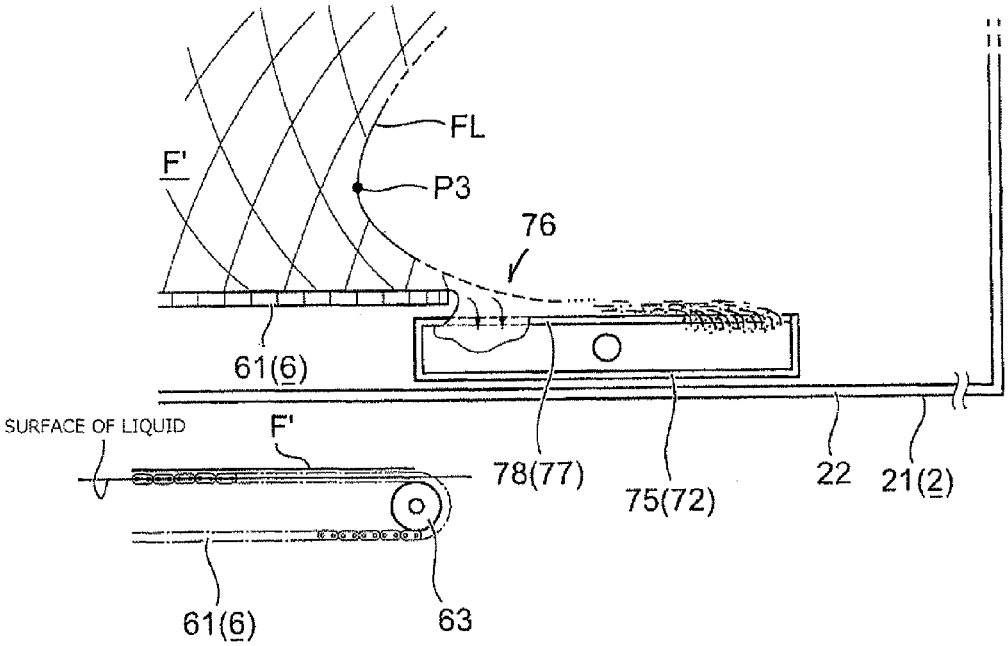
FIG. 7 is an explanatory diagram illustrating and comparing a situation where the action of holding the film by the chain conveyer is exerted up to the overflow tanks of the liquid surface residual film collecting mechanism and a situation where the action of holding the film is not exerted up to the overflow tanks.
Figure 7:
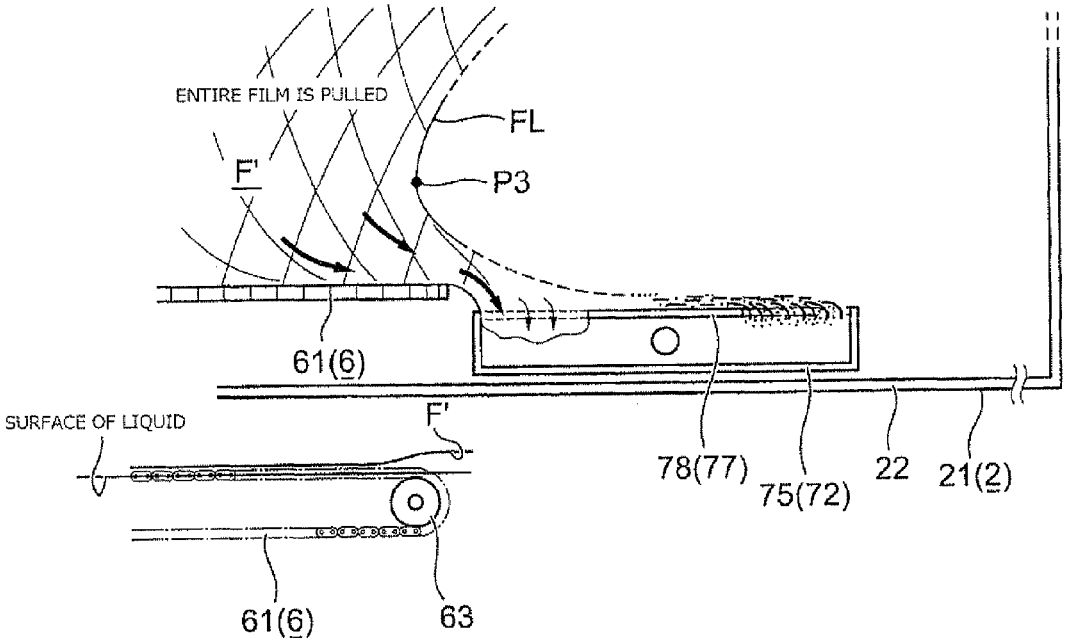

First, FIG. 7(*b*) shows a case where the chain conveyer 61 does not overlap with the overflow tank 75. At this occasion, the sprocket 63 (conveying end termination portion) of the chain conveyer 61 is located at the upstream side with respect to the overflow tank 75. In this case, both sides portions (streak form portions) of the liquid surface residual film F' held by the chains 62 are no longer held by (in contact with) the chains due to the force of the dropping liquid of a fast flow rate of the overflow tank 75. In other words, in this state, as shown in the figure, first, both end parts of the liquid surface residual film F' are pulled by the overflow dropping liquid, and the holding is cancelled, so that this is applied to the upstream side and may cause bending of the pattern in the entire film. It is to be understood that the effect of this kind of bending of the pattern may result in deformation of the pattern of the transfer film F in the immersion area P1.

In contrast, as shown in FIG. 7(*a*), when the chain conveyer 61 is overlapped with the overflow tank 75 to some extent, the action of holding the film by the chain conveyer 61 takes effect until the liquid surface residual film F' reaches the overflow tank 75. Therefore, both side portions of the liquid surface residual film F' is reliably held by the chain conveyers 61 until the liquid surface residual film F' reaches the discharge ports 76. The liquid surface residual film F' introduced to the overflow tank 75 (at a side before the blocking means 77) drops with the water as if the liquid surface residual film F' moves around the end of the chain conveyer 61, and the liquid surface residual film F' is reliably collected without adversely affecting the transfer position.

In this case, for example, in the embodiment of FIG. 3 above, the screen board 78 is used as the blocking means 77. However, the blocking means 77 may be in other forms. For example, as shown in FIG. 8, the blocking means 77 may be in such a form that the blocking means 77 is accommodated within the overflow tank 75, which is preferable (this will be referred to as in-tank blocking body 79).

Figure 8:
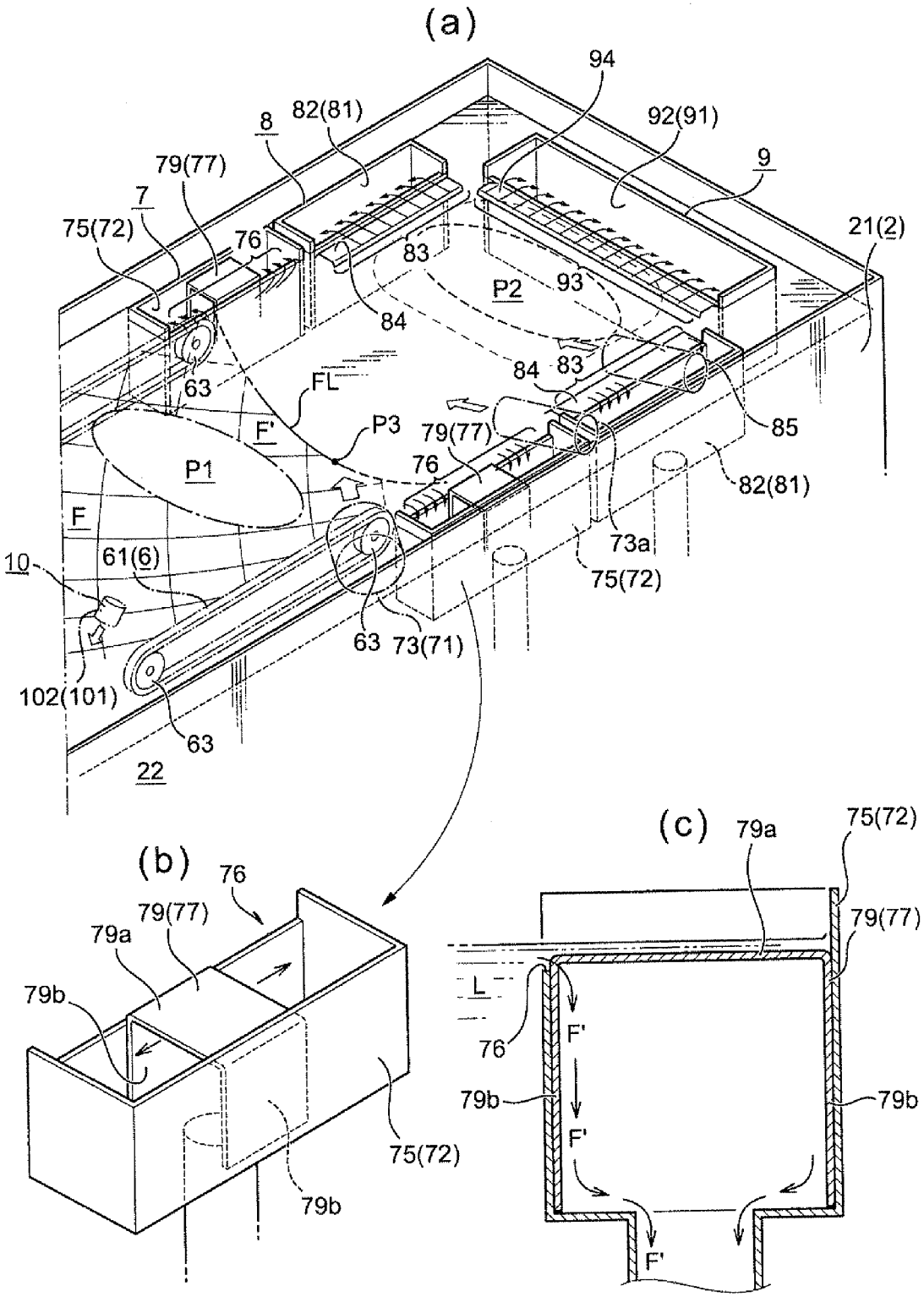
FIG. 8 includes a structural perspective view (a) illustrating a transfer tank to which an in-tank blocking body is applied as blocking means for blocking collecting of the liquid by the overflow tanks, and a perspective view (b) and a cross sectional view (c) enlarging and illustrating the overflow tanks having the in-tank blocking bodies provided therein.

That is, the in-tank blocking body 79 as shown in FIG. 8 is, for example, a gutter form member having a C-shaped cross section. However, this is not used as a container (gutter) for receiving the collected liquid. As shown in FIG. 8(*b*), the in-tank blocking body 79 is accommodated (dropped) in the overflow tank 75 such that the opening portion (aperture portion) having the C shaped cross section face downward, and the upper opening side of the overflow tank 75 is partially closed by the central flat portion of the C shaped cross section. Therefore, the in-tank blocking body 79 is installed in the overflow tank 75 in a so-called bridge manner, and in this installation state, the flat portion located at the upper portion of the in-tank blocking body 79 (portion that closes the overflow tank 75) performs the action of dam just like the screen board 78. Due to such fact, the flat portion will be denoted as a dam action unit 79*a*. On the other hand, portions provided at both sides of the dam action unit 79*a* to face each other will be denoted as foot units 79*b*. The both foot units 79*b* are accommodated within the overflow tank 75, so that the in-tank blocking body 79 is allowed to move only in the front and back direction.

It should be noted that when the in-tank blocking body 79 is formed in the C shape, there is an advantage in that the in-tank blocking body 79 (fixing means 77) can be fixed by just dropping this into the overflow tank 75, and the discharge positions at two stages before and after the in-tank blocking body 79 and the discharge balance can be easily adjusted and changed by moving this in the front and back direction (sliding in the longitudinal direction of the transfer tank 2).

With regard to this point, the screen board 78 explained above is usually installed vertically in the discharge port 76 of the overflow tank 75, and therefore, fixing means is separately required to attach the screen board 78 to the overflow tank 75 (discharge port 76), and it should be attached and detached when the above adjustment is made. In contrast, the in-tank blocking body 79 does not require such fixing means, and the adjustment can be done extremely easily.

In this case, as explained above, the in-tank blocking body 79 blocks the collection of the liquid by the overflow tank 75, and therefore, as shown in FIG. 8(*c*), the dam action unit 79*a* (top surface) is set at a level higher than the discharge port 76 of the overflow tank 75 (for example, about 1 to 3 mm) It should be noted that this dam action unit 79*a* is set at a level slightly lower than the surface of the transfer liquid L as shown in FIG. 8(*c*) (for example, about 2 to 3 mm), and this means that, during normal discharge amount setting, the in-tank blocking body 79 is slightly under the liquid. However, even in such state, there occurs a difference of speed of collection of the liquid (the speed of collection of the liquid is slower in the portion of the dam action unit 79*a*) between the dam action unit 79*a* and the portions of the discharge ports 76 at which the in-tank blocking body 79 (dam action unit 79*a*) is not provided, and this sufficiently achieves the function of dam.

Further, when the dam action unit 79*a* is set at a level slightly under the liquid, the film residues are less likely to be stuck with the portion, and even if the film residues are stuck and stopped (overridden and stopped) at the portion, this can be collected, and the transfer liquid L in the transfer tank 2 is not contaminated.

In this point, the screen board 78 explained above has a generally-available dam structure, and the screen board 78 protrudes above the surface of the transfer liquid L. Therefore, the film residues may get stuck with the screen board 78, and in such case, the film residues will gradually crash into pieces and drop in the transfer tank 2, which may contaminate the transfer liquid L.

Figure 9:
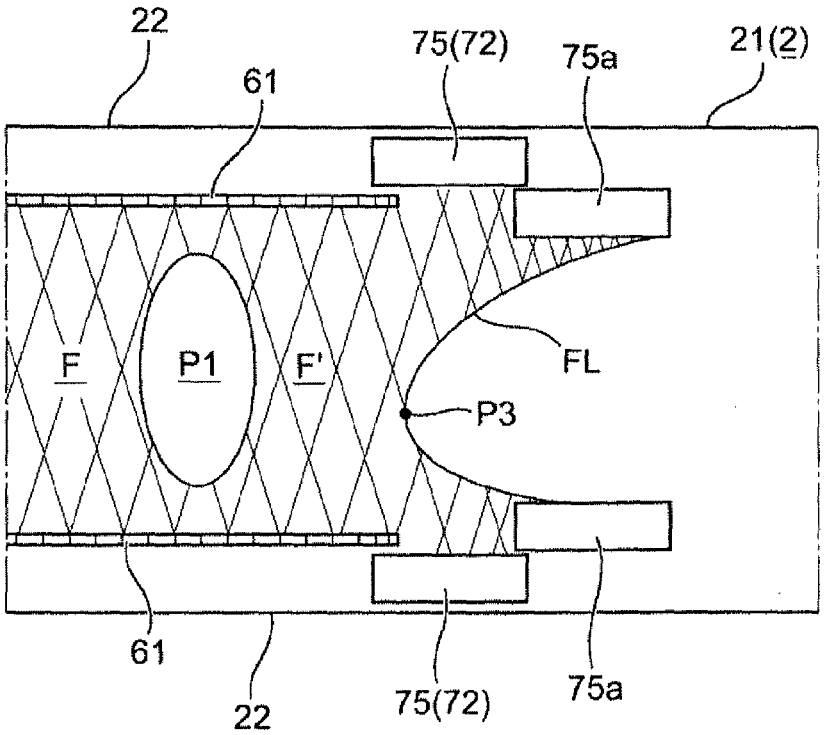
FIG. 9 is a top view illustrating a transfer tank in which the liquid surface residual film is divided into two parts in the direction of the flow of the liquid, which are collected at four locations.

When the liquid surface residual film F' is collected at the portion of the side wall 22 of the transfer tank 2, the liquid surface residual film F' may not be necessarily collected at one location per one side (at one location of each of the right and left side walls 22) For example, as shown in FIG. 9, the liquid surface residual film F' may be collected at two locations per one side. It should be noted that in the embodiment of FIG. 9, it is difficult for the air blowing device 73 serving as the dividing means 71 to set the amount of air blow at a high level, and this embodiment is configured such that, when there is no performance to push the liquid surface residual film F' to the outsides of the chain conveyers 61, auxiliary overflow tanks 75*a* (discharge means 72) are additionally provided at the inside of the chain conveyer 61. However, in this case, the auxiliary overflow tank 75*a* is somewhat provided in a protruding manner in the center of the transfer tank 2 (on a conveying path of the object W), and therefore, it is necessary to pay attention so that the overflow tanks 75*a* do not block the conveying of the object W. Even when the liquid surface residual film F' is divided into two parts in this manner, subsequent collection may be done at four locations (two locations per one side), and the number of parts into which the liquid surface residual film F' is divided by the dividing means 71 is not necessarily the same as the number of locations where the liquid surface residual films F' are collected.

It should be noted that the liquid surface residual film collecting mechanism 7 (discharge means 72) is not necessarily limited to the overflow structure. Other collecting methods may also be employed. For example, a vacuum method may be employed, in which the transfer liquid L in proximity to the surface of the liquid as well as the divided liquid surface residual films F' are sucked. In other words, in this case, a sucking nozzle is employed as the discharge means 72.

In the present embodiment, a liquid-leaving area cleaning mechanism 8 is further provided in a stage subsequent to the liquid surface residual film collecting mechanism 7. This structure will be hereinafter explained. The liquid-leaving area cleaning mechanism 8 is a mechanism for mainly removing foreign substances and bubbles A on the surface of the liquid and in the transfer liquid at the decoration-unnecessary surface S2 (the back side of the design surface S1) in the liquid-leaving area P2. Examples collected by the liquid-leaving area cleaning mechanism 8 include film residues generated when the object W is immersed so as to pierce the transfer film F (relatively small residues in a form of waste strings and the like made up with the water-soluble film and the ink which are mixed), redundant film which attach to a jig J and the object W during immersion and once sink under the surface of the liquid and which are thereafter discharged into the water, and many bubbles A and film residues generated on the surface of the liquid at the side of the decoration-unnecessary surface S2 of the object W when the object W (jig J) moves out of the liquid.

This structure continuously moves away these foreign substances and the bubbles A from the liquid-leaving area P2 while the object W is still in the transfer liquid L, so as to clean the liquid-leaving area P2 and at the same time prevent them from moving in to the side of the design surface S1 of the object W as much as possible.

For example, as shown in FIGS. 1 to 3, the liquid-leaving area cleaning mechanism 8 includes the overflow tanks 82 serving as the discharge means 81 which are provided at both right and left sides of the liquid-leaving area P2, and the overflow tank 82 is provided to overlap with the liquid-leaving area P2 in the state of view from the side surface. More specifically, the discharge means 81 (the overflow tanks 82) are provided inside of the both right and left side walls 22 in the liquid-leaving area P2 of the transfer tank 2, so that the flow of the liquid flowing from the liquid-leaving area P2 to the overflow tanks 82 (this will be referred to as side oppositely-separating flow) is generated mainly in proximity to the surface of the liquid. The bubbles A and foreign substances such as film residues are carried by this side oppositely-separating flow, and are collected by the overflow tanks 82, so that they are discharged to the outside of the tank. Therefore, in the top view, as shown in FIGS. 1 and 2, the overflow tanks 75 for collecting the liquid surface residual films and the overflow tanks 82 for cleaning the liquid-leaving area are provided adjacently in series. In this case, in the overflow tanks 82, the collecting ports through which foreign substances such as film residues are introduced together with the transfer liquid L will be referred to as discharge ports 83.

For example, as shown in FIG. 3, the overflow tanks 82 for cleaning the liquid-leaving area may be formed with brims for guiding the collected liquid in the discharge ports 83. In particular in the present embodiment, the protruding length from the discharge port 83 to the processing tank 21 is formed to be relatively long. This is to make a structure for increasing the flow rate of the transfer liquid L introduced to the overflow tanks 82 (for this reason, this brim will be referred to as a flow rate increase brim 84).

It should be noted that the transfer liquid L collected by the overflow tanks 82 has a relatively low mixing ratio of foreign substances. Therefore, the foreign substances are preferably removed from the collected liquid by the cleaning device 24 such as filtering, and thereafter, the collected liquid is provided for recycled use (see FIG. 2).

As described above, the liquid-leaving area cleaning mechanism 8 is to collect the foreign substances and the bubbles A on the surface of the liquid in the liquid-leaving area P2 (at the side of the decoration-unnecessary surface S2), and therefore, in order to reliably collect the foreign substances and the bubbles A, it is preferable to blow air onto the surface of the liquid in the liquid-leaving area P2, thereby actively pushing the foreign substances and the bubbles A to the overflow tanks 82 (flow rate increase brim 84). More specifically, in the present embodiment, as shown in FIGS. 1 to 3, the air blowing device 85 is provided on one of the side walls 22 of the transfer tank 2 (above the overflow tank 82), and many foreign substances such as the bubbles A the film residues generated on the surface of the liquid in the liquid-leaving area P2 (at the side of the decoration-unnecessary surface S2) by this air blow from the air blowing device 85 are moved and collected to the overflow tank 82 arranged at the side opposite to the position where the air blowing device 85 is installed.

As described above, in the liquid-leaving area P2, the bubbles A and the foreign substances on the surface of the liquid are continuously removed by the air blowing device 85, and the foreign substances in the liquid are also collected by the overflow tank 82, and therefore, with the synergetic effect thereof, high degree of cleanness can be achieved, and at the same time, the foreign substances can also be prevented from moving around to the side of the design surface S1 of the object W.

Further, as described above, the air blowing device 85 is provided to act on the surface of the liquid in the liquid-leaving area P2, and when the air blowing device 85 and the air blowing device 73 for dividing the liquid surface residual film F' are considered, multiple air blowing devices are provided in total in this apparatus. However, depending on various kinds of transfer conditions, the shape of, e.g., the object W, and the aspect of the object conveying device 5, the air blown to divide the liquid surface residual film F' may be sufficient to continuously move the bubbles A and the foreign substances on the surface of the liquid in the liquid-leaving area P2 to the overflow tanks 82. In such case, the air blowing device 73 for dividing the film can also be used as the air blowing device 85 for cleaning the liquid-leaving area, and further, they may be combined into one air blowing device capable of dividing the film as well as cleaning the liquid-leaving area.

Not only the above overflow structure but also other discharge methods can be employed as the discharge means 81 of the liquid-leaving area cleaning mechanism 8. For example, a vacuum method may be employed, in which the transfer liquid L having foreign substances mixed therein is sucked mainly in proximity to the surface of the liquid. In other words, in this case, a sucking nozzle is employed as the discharge means 81.

Subsequently, the design surface cleaning mechanism 9 will be explained, but before explaining the design surface cleaning mechanism 9, the bubbles A generated at the side of the design surface S1 in the liquid-leaving area P2 will be explained. In the liquid-leaving area P2, the objects W (jigs J) are successively raised obliquely upward from the surface of the liquid. Above the object W moving out of the liquid, the object W and the jig J that have already been raised above the surface of the liquid are located (which will be referred to as the object W and the jig J that have been raised previously). At this occasion, for example, the transfer liquid L may drop as drips from the object W and the jig J that have been raised previously to the surface of the liquid of the transfer tank 2, and the dropped drips bounce on, for example, the surface of the liquid to become the bubbles A, which may attach to the design surface S1 of the object W moving out of the liquid. Thereafter, when ultraviolet rays or the like are emitted on the object W in this state, a defect of deformation of the transfer pattern (decorative layer) and a defects (so called pinhole) of loss of the pattern may occur in the portions to which the bubbles A attach, because of the reasons such as stress caused by the bubbles A and refraction caused by the ultraviolet rays. Therefore, in the present embodiment, the design surface cleaning mechanism 9 is provided for the purpose of, e.g., cleaning the design surface S1 of the object W ascending from the transfer liquid L (action mainly caused by new water explained later), removing the bubbles A generated on the surface of the liquid at the side of the design surface S1, and eliminating foreign substances in the transfer liquid and on the surface of the liquid in the liquid-leaving area P2.

Hereinafter, the design surface cleaning mechanism 9 will be further explained. The design surface cleaning mechanism 9 is provided to form the flow of the liquid flowing downstream from the design surface S1 of the object W moving out of the liquid (this flow will be hereinafter referred to as design surface oppositely-separating flow because this is a flow moving away from the design surface S1). The object of the design surface oppositely-separating flow is to, for example, prevent the foreign substances dispersed and accumulated in the transfer liquid L from moving closer (attaching to) to the design surface S1 as much as possible as described above, and moving the bubbles A and the foreign substances, which are on the surface of the liquid generated by the drips dropped from the object W raised previously, away from the design surface S1 and discharging the bubbles A and the foreign substances to the outside of the tank. Therefore, the design surface oppositely-separating flow is preferably formed by applying clean water not including any foreign substance or purified water made by removing the foreign substances from the collected liquid (which will be collectively referred to as new water).

Figure 10:
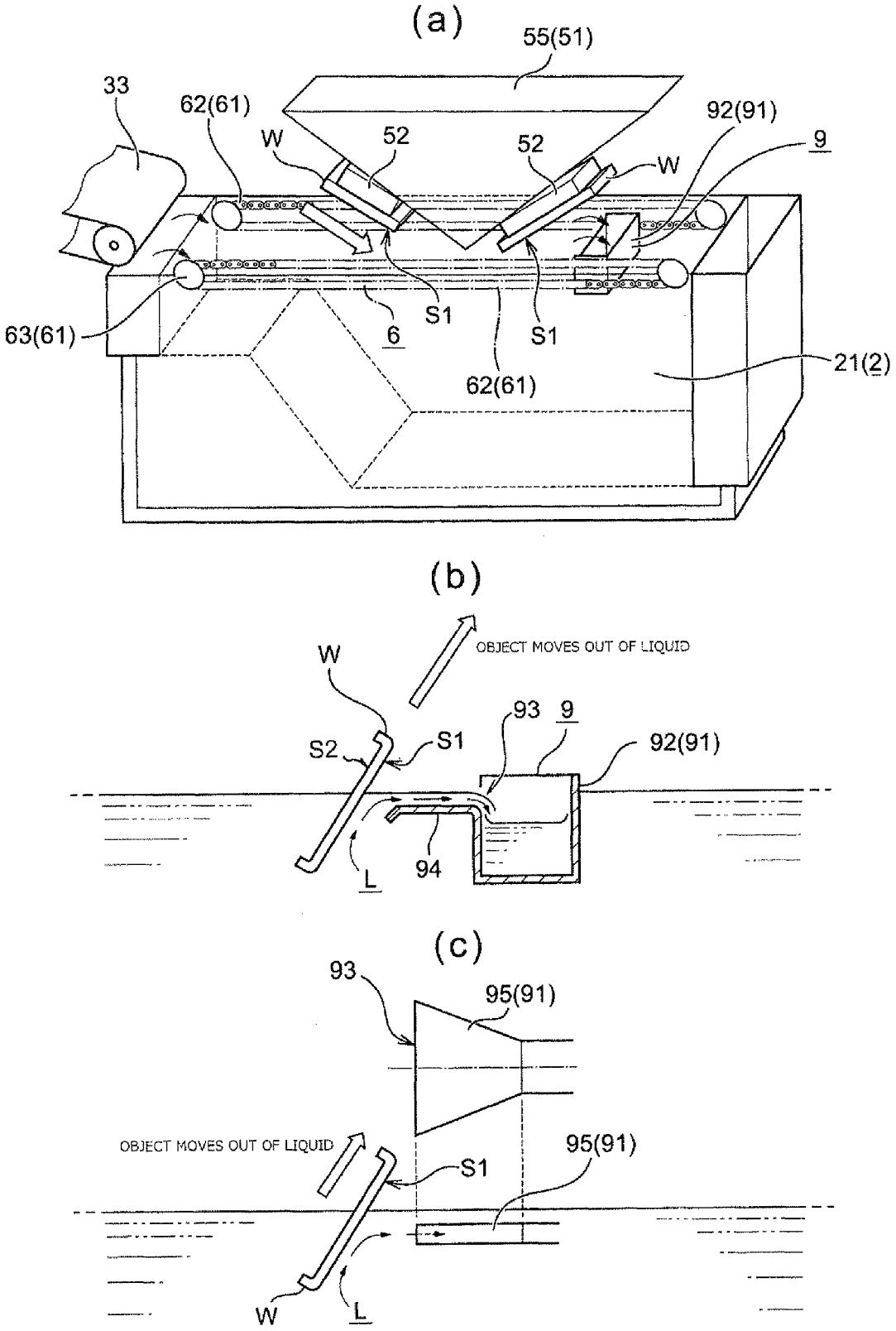
FIG. 10 is an explanatory diagram illustrating a transfer tank provided with a design surface cleaning mechanism for forming an oppositely-separating flow on the design surface of the object removed out of the transfer liquid.

Because of such facts, for example, as shown in FIG. 10(*a*), the design surface cleaning mechanism 9 has the overflow tank 92 serving as oppositely-separating flow forming means 91 at the side of the design surface S1 of the object W moving out of the liquid in the liquid-leaving area P2. More specifically, in the present embodiment, the object W ascends in the liquid-leaving area P2 in an inclined state in which the design surface S1 faces the lower side, and therefore, the overflow tank 92 facing the design surface S1 of the object W is provided, whereby the design surface oppositely-separating flow, which flows from the lower side to the upper side of the ascending object W (design surface S1), is formed. In this case, in the overflow tank 92, a collecting port for mainly introducing new water together with the transfer liquid L will be referred to as a discharge port 93.

It should be noted that the design surface oppositely-separating flow is preferably formed by supplying new water as described above, and therefore, for example, in FIG. 2, some of the cleaned water provided by the circulating pipe path 23 is supplied to the design surface S1 of the object W at a level below the overflow tank 92 serving as the oppositely-separating flow forming means 91. More specifically, some of the cleaned water is supplied at a level between around a middle level of the transfer liquid level and around the surface of the liquid. Some of this cleaned water supply (new water supply) is preferably used for the side oppositely-separating flow of the liquid-leaving area cleaning mechanism 8 explained above, and in this case, the above new water supply also contributes to the liquid-leaving area cleaning mechanism 8.

Now, easiness of attachment of the foreign substances to the design surface S1 without the design surface cleaning mechanism 9 will be explained. Usually, the object W pulled out of the transfer liquid L ascends in such a state as to somewhat block the flow of the transfer liquid L flowing from the upstream to the downstream. At this occasion, the blocked transfer liquid L flows so as to move around the object W below the object W or at the sides of the object W, and this makes the flow flowing to the design surface S1 facing the downstream side (curling flow).

When the object W is pulled up from the liquid, force flowing from a position close to the surface of the liquid of the object W to the object W is exerted due to a speed difference between the pull-up speed of the object W and surface of the liquid at rest.

Therefore, the curling flow (flow toward the design surface S1) is automatically formed at the design surface of the object W moving out of the liquid. Accordingly, if no countermeasure is taken, the foreign substances dispersed and accumulated in the transfer liquid L may be attracted to the design surface S1 and may attach to the design surface S1. For this reason, in the present embodiment, the design surface oppositely-separating flow made by the design surface cleaning mechanism 9 is provided to cancel the flow of the transfer liquid L flowing to the design surface S1, or suppress the flow as much as possible.

In the overflow tank 92 for cleaning the design surface, for example, as shown in FIGS. 3 and 10(*b*), the flow rate increase brim 94 is formed in the discharge port 93, and this is to increase the flow rate of the transfer liquid L introduced to the overflow tank 92.

It should be noted that the oppositely-separating flow forming means 91 in the design surface cleaning mechanism 9 is not necessarily limited to the overflow structure explained above. Alternatively, other discharge methods may be employed. For example, as shown in FIG. 10(*c*), a vacuum method may be employed, in which the transfer liquid L having foreign substances and the new water are sucked mainly in proximity to the surface of the liquid. In other words, in this case, a sucking nozzle 95 is employed as the oppositely-separating flow forming means 91.

Figure 11:
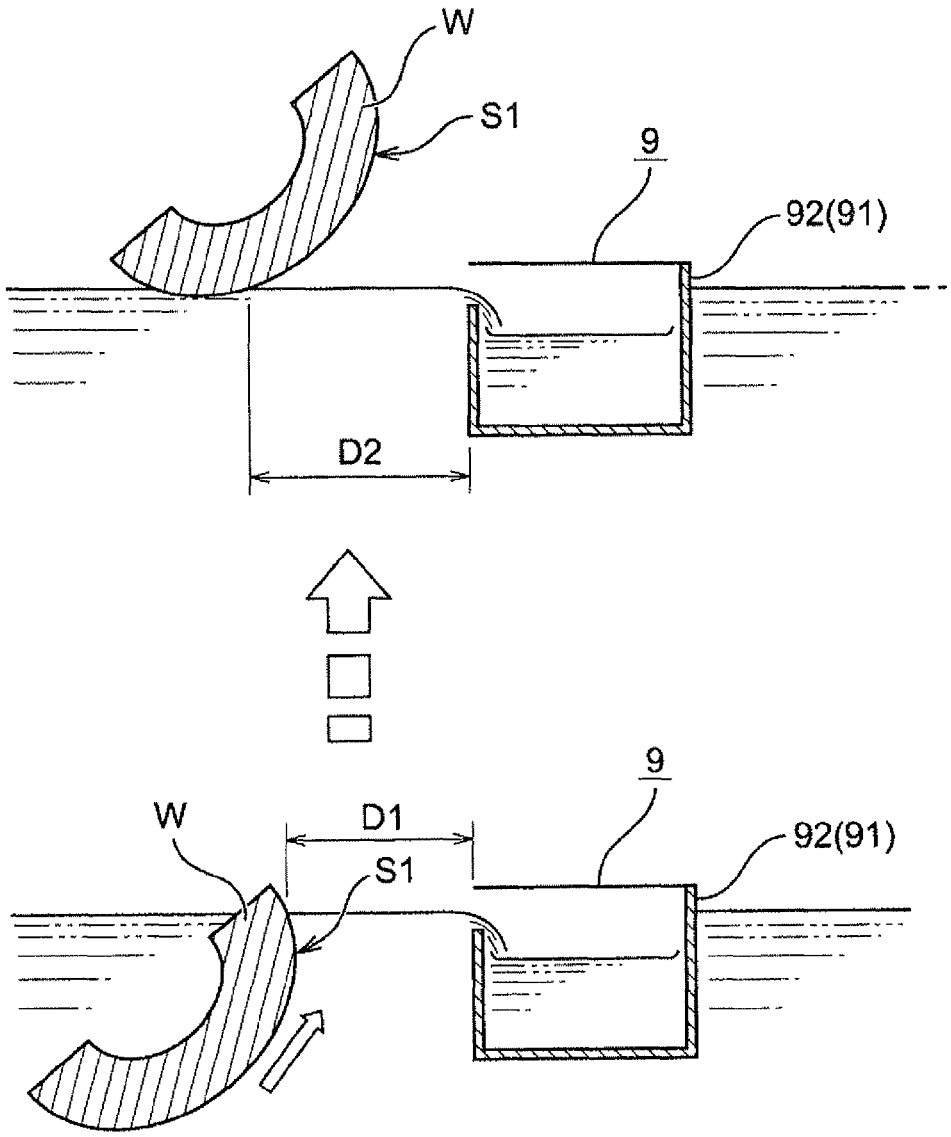
FIG. 11 is an explanatory diagram indicating that depending on, e.g., the state of the curve and the degree of projections and depressions of the object, the design surface may gradually move away from the overflow tank serving as the oppositely-separating flow forming means even if the object is pulled up with a constant inclined state.

In order to reliably cause the design surface oppositely-separating flow to act on the design surface S1 of the object W moving out of the liquid, the overflow tank 92 (discharge port 93) serving as the oppositely-separating flow forming means 91 is preferably provided in proximity to the object W (design surface S1) moving out of the liquid (for example, about 10 to 200 mm). However, for example, as shown in FIG. 11, depending on, e.g., the state of the curve and the degree of projections and depressions of the object W (design surface S1), the design surface S1 may gradually move away from the overflow tank 92 (discharge port 93) even if the object W is pulled up with a constant inclined state (in the figure, D1 denotes the distance between them both as soon as the object W begins to move out of the liquid, and D2 denotes the distance between them both when the object W has been moved out of the liquid). Therefore, the overflow tank 92 is preferably configured to be able to move in the longitudinal direction of the transfer tank 2 (the direction of the flow of the liquid). In other words, the overflow tank 92 is preferably configured to be able to flexibly move closer to and move away from the object W that is moving out of the liquid. It is to be understood that as long as the discharge force (collecting force) of the transfer liquid L in the overflow tank 92 can be changed as necessary or in short, as long as the strength of the design surface oppositely-separating flow can be changed as necessary, the same effects can be achieved by increasing the collecting force of the transfer liquid L even if the object W relatively moves away as it is removed out of the liquid. By the way, an example of other methods for increasing the collecting force includes decreasing the liquid level (water level) of the overflow tank 92.

In this case, in the present embodiment, totally three types of overflow tanks 75, 82, 92 are provided as described above (the action and the object of each of them is different). In addition, an overflow tank may be provided at the end (the most downstream portion) of the transfer tank 2 (see FIG. 10(*a*)). In the past, in many cases, a transfer tank has an overflow tank at the end, and the present embodiment is a case where such a conventional transfer tank is used to install the overflow tanks 75, 82, 92 as the respective mechanisms explained above. By the way, in the conventional transfer tank, the overflow tank installed at the end of the transfer tank is used to maintain the level of the surface of the transfer liquid L at a substantially constant level and circulate and use the transfer liquid L while collecting the liquid surface residual film F' and the like.

As described above, in the liquid pressure transfer, various kinds of transfer films F (transfer patterns) and activating agents in various kinds of states are applied, and because variously different sizes of objects W are processed, the immersion area P1 may be moved in the front or the back by, for example, about 800 mm, and accordingly, the liquid-leaving area P2 may also be moved in the front or the back by, for example, about 800 mm to 1200 mm. For this reason, the immersion area P1, the cancellation position of the film holding mechanism 6 (the position of sprocket 63 where the action of holding the film is terminated), the dividing means 71 of the liquid surface residual film collecting mechanism 7 (the air blowing devices 73, 73*a*), the overflow tanks 75, the overflow tanks 82 of the liquid-leaving area cleaning mechanism 8, the air blowing device 85, the overflow tank 92 of the design surface cleaning mechanism 9 (oppositely-separating flow forming means 91), and the like are in closely related positional relationship. Therefore, as the immersion area P1 is moved, each of the above constituent unit members are preferably moved at the same time or independently, and for this reason, in the present embodiment, for example, as shown in FIG. 2, the sprockets 63 at the end termination portion of the action of holding the film, the air blowing devices 73, 73*a*, 85, the overflow tanks 75, 82 are mounted on a movable frame 29 in the longitudinal direction of the transfer tank 2 (in the front and back direction), the overflow tank 92 is configured to be mounted on a movable frame 30 that can move in the front and back direction independently, and they are configured to be able to move as necessary according to the move of the immersion area P1 and the liquid-leaving area P2.

By the way, the method for moving each of the frames 29, may be manual, or the movement of each of the frames 29, 30 may be automatically controlled using a linear motor and the like (actually, it is practical to use a program for automatically moving the positions of the frames 29, 30 according to, e.g., a program for pulling up the object W.).

In the present embodiment, inclined plates 27 are sunk and installed at a bottom portion of the transfer tank 2. More specifically, the inclined plates 27 are sunk and installed in proximity to the bottom portion of the liquid-leaving area P2. The inclined plates 27 will be hereinafter explained. The inclined plates 27 include multiple plate members arranged with a substantially regular interval in such a manner that the inclined plates 27 have a descending inclination from the upstream side of the transfer tank 2 to the downstream side, and the inclined plates 27 are provided before a water intake opening 28 for circulating and using the transfer liquid L in the transfer tank 2 (the inclined plates 27 are provided such that the water intake opening 28 is located at the farther side of the inclined plates 27). In this configuration, the inclined plates 27 use the slow flow of the liquid caused by circulating-returning flow in the bottom portion of the transfer tank 2 and the flow of the liquid caused by substantially horizontal movement of the object W in the liquid (above the inclined plates 27) to cause the foreign substances to flow into the inclined plates 27 and capture them. Therefore, the inclined plates 27 are provided to sink and capture the foreign substances dispersed and accumulated in the transfer liquid L and suppress re-ascending of the foreign substances, whereby the inclined plates 27 performs the action of preventing the foreign substances from circulating in the transfer liquid L (in other words, cleaning and purifying the transfer liquid L).

When the transfer film F is supplied to the transfer tank 2 in the present embodiment, the elongation and extension reduction prevention mechanism 10 is provided to reduce extension of the transfer film F, and this mechanism will be hereinafter explained. The elongation and extension reduction prevention mechanism 10 is provided to prevent the activating agent component K from separating and oozing from the surface of the film to the surface of the transfer liquid L as the transfer film F comes into contact with the liquid, and prevent the activating agent component K from staying on the surface of the liquid, making a film, and blocking extension of the transfer film F. Therefore, both sides of the transfer film F supplied to the surface of the transfer liquid L are reliably attached to the chains 62 provided in proximity to the side walls 22 of the transfer tank 2. In the explanation below, first, the reason (details) why the extension of the transfer film F is blocked by the activating agent component K flowing out of the transfer film F coming into contact with the liquid will be explained.

During the transfer, the activating agent is applied to the transfer film F in order to activate the transfer pattern, and some of the activating agent applied to the film moves away from (is separated from) the surface of the transfer film F as the transfer film comes into contact with the liquid (contact with the transfer liquid L), whereby the activating agent flows (oozes) onto the surface of the transfer liquid L (this is mainly referred to as the activating agent component K in this specification). The outflow of the activating agent component K to the surface of the liquid is not necessarily limited to the direction in which the transfer film F is supplied (the direction of the flow of the liquid), and the activating agent component K may flow in various directions, but since, e.g., the flow of the liquid is generated and the film is supplied, it is considered that the (preceding) outflow to the direction in which the film is supplied is relatively large. Because of such facts, when the liquid pressure transfer is repeatedly performed, the activating agent component K increases on the surface of the transfer liquid L little by little, and for example, the activating agent component K is accumulated in proximity to the side walls 22 of the transfer tank 2 where the flow of the liquid is weak. Then, the activating agent component K accumulated in proximity to the side walls 22 is condensed at the surface of the liquid, and attains a state as if a film (oil film) is formed by oil component on a water surface (for the sake of convenience, this will be referred to as liquid film), and this performs an action of rejecting elongation (extension) of the transfer film F. In other words, when the liquid pressure transfer is continued, the elongation (extension) of the film is blocked by the liquid film formed by the activating agent component K.

There are other factors for blocking the extension of the transfer film F supplied to the surface of the transfer liquid L. For example, almost all the transfer liquid L in the transfer tank 2 is circulated and used in view of, e.g., the environmental protection and efficient use of resources (recycling). Therefore, the activating agent component K (liquid film) discharged to the surface of the transfer liquid L is not only simply accumulated (the activating agent component K not only drifts) on the surface of the liquid but also some of the activating agent component K is also dissolved into the transfer liquid L. For this reason, when the liquid pressure transfer is repeatedly performed, the concentration of the activating agent gradually increases in the transfer liquid L, and which increases the viscosity of the transfer liquid L, and this is also one of the factors for blocking the elongation of the transfer film F.

Further, when the activating agent of ultraviolet curing resin is used, the activating agent component K is cured with a low amount of light even in the indoors, and therefore, the viscosity of the transfer liquid L tends to be further increased. In addition, because of social environment in which almost all of the transfer liquid L is reused to suppress the amount of waste liquid as described above, this is one of the factors why the viscosity of the transfer liquid L is further increased. However, since the liquid pressure transfer requires transfer process with a high degree of stability, the surface of the transfer liquid L is stabilized, e.g., wave is suppressed, as a matter of course, and it is true that this performs an action of preventing the activating agent (resin component) from mixing into the transfer liquid L.

It should be noted that the phenomenon that the elongation of the transfer film F is blocked by the activating agent component K on the surface of the transfer liquid L is more conspicuous with an activating agent that is used for the liquid pressure transfer in which a transfer pattern also having the surface protection function is formed (liquid pressure transfer that does not require the top coating). This is considered that the activating agent used therefor has a high level of viscosity than ordinary solvent type, and therefore, this tends to greatly suppress the extension of the transfer film F.

Figure 20:
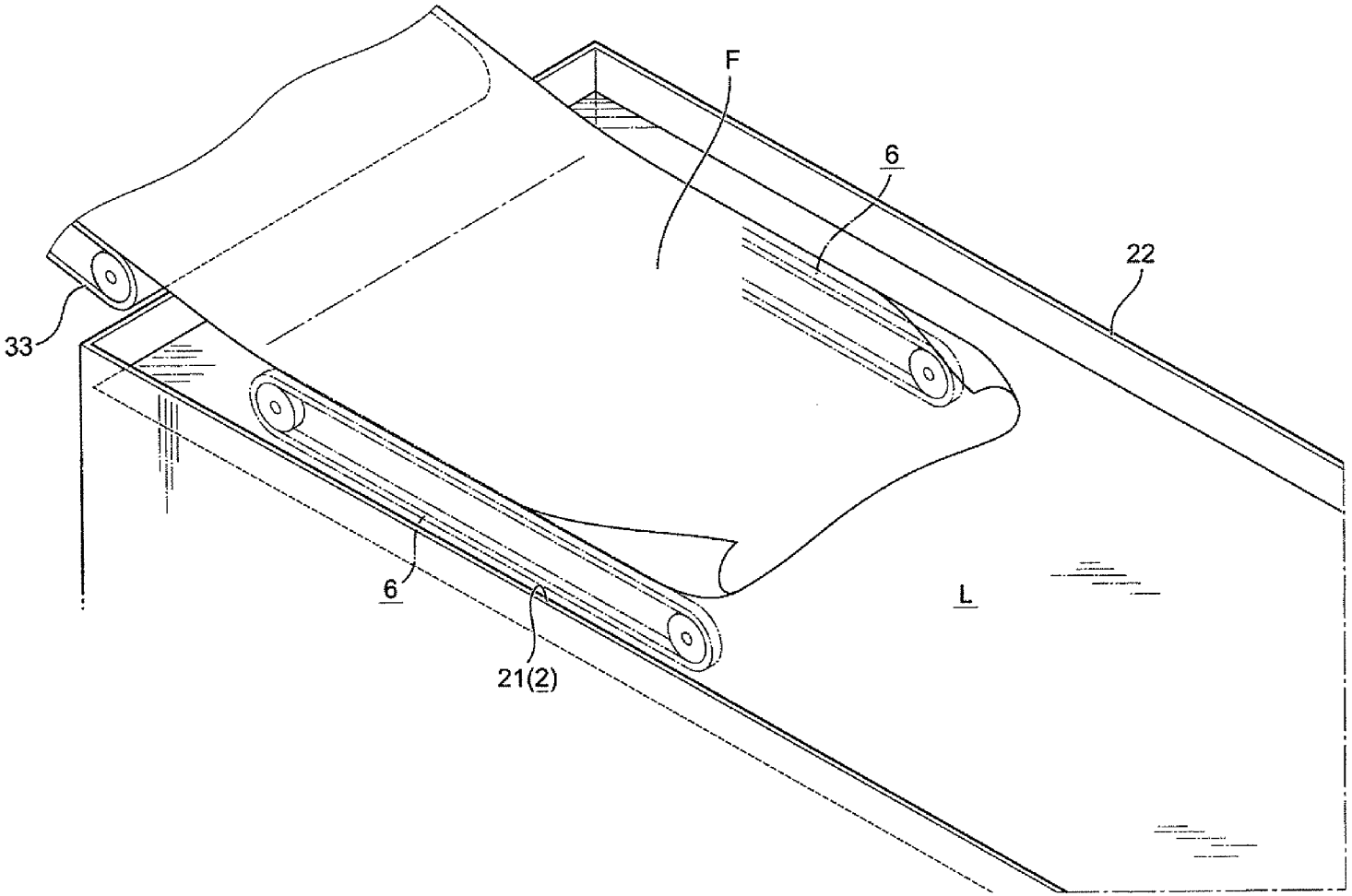
FIG. 20 is an explanatory diagram schematically illustrating how a transfer film supplied onto the transfer liquid surface curls upward due to a difference of elongation between a transfer pattern at an upper side and a water-soluble film at a lower side in general.

Moreover, in general, as shown in FIG. 20, the transfer film F supplied to the surface of the transfer liquid L gradually curls upward due to the difference of extension between the transfer pattern located at the upper side of the surface of the transfer liquid L and the water-soluble film located at the lower side thereof (the elongation rate of the water-soluble film is higher), and this makes it harder for the transfer film F supplied to the transfer tank 2 to come into contact with the film holding mechanism 6 provided in proximity to the side walls 22.

Therefore, when the liquid pressure transfer is repeatedly performed without the elongation and extension reduction prevention mechanism 10, the transfer film F that initially extended to the chains 62 after the transfer film F comes into contact with the liquid does not attach, and for this reason, the elongation and extension reduction prevention mechanism 10, is provided in the present embodiment to prevent this kind of reduction of the extension.

In this case, in the present embodiment, the blow method is employed as the elongation and extension reduction prevention mechanism 10, which blows air to remove the activating agent component K that extends as the liquid film on the surface of the transfer liquid L between the film holding mechanism 6 (chain conveyer 61) and the transfer film F and blocks the elongation of the transfer film F. More specifically, for example, as shown in FIG. 1, this mechanism blows air to portions in proximity to the side walls 22 where the flow of the transfer liquid L (the flow of the liquid) is considered to weaken and the activating agent component K is considered to be likely to be accumulated. In particular, the mechanism preferably pushes (moves) the activating agent component K located (floating) at the portions at both left and right sides of the air blowing device 26 to positions between the film holding mechanism 6 and the side walls 22. By the way, because, e.g., the portions between the film holding mechanism 6 and the side walls 22 are set so that the upper surfaces of the chain conveyers 61 are at a position higher than the surface of the transfer liquid L, and are portions that substantially do not affect the transfer position or gives extremely small effects on the transfer position. Therefore, in the present embodiment, the activating agent component K is pushed to the portions. In the present embodiment, as described above, the air blowing device 26 performs the action of extending the transfer film F to portions therearound. In this case, in order to clearly distinguish the mechanism from the action of the air blowing device 26, the mechanism is referred to as the elongation and extension reduction prevention mechanism 10.

In the present embodiment, as described above, the overflow tanks 75 are provided, outside of the chain conveyers 61 serving as the film holding mechanism 6, along the both side walls 22 of the transfer tank 2, and accordingly, the activating agent component K, moved to the portions between the film holding mechanism 6 and the side walls 22, is collected by the overflow tanks 75. It is to be understood that, in this case, for example, as also shown in FIG. 3, the discharge ports 76*a* for introducing and collecting the activating agent component K are also formed at the front edge sides (upstream side) of the overflow tanks 75.

Further, in the embodiment as shown in FIG. 1, two compressed air blow nozzles 102 are applied as the elongation and extension reduction prevention mechanism 10 (removing means 101). More specifically, originally, the transfer film F supplied to the transfer tank 2 absorbs the transfer liquid L to swell and soften, and gradually extends in all directions. Therefore, in FIG. 1, air is blown from the two compressed air blow nozzles 102 to act on (to come into contact with) the surface of the liquid that faces the extending edge of the transfer film F, whereby the activating agent component K mainly floating in proximity to the edge is removed from there, and the transfer film F is elongated in directions of both sides in proximity to the edge (reduction of elongation is prevented). In this case, the compressed air blow nozzle 102 preferably includes a multi-joint flexible hose as shown in the figure. This is because fine adjustment of, e.g., the position of the nozzle and the direction of air blow, can be easily made.

By the way, the air blow for removing the activating agent component K is preferably not done in such a manner that air acts on (coming into contact with) the transfer film F, and is preferably done in such a manner that air acts on only the surface of the transfer liquid having no film. This is to stably hold the surface of the transfer liquid and to convey the transfer film F to the transfer position (immersion area P1) in a state in which waves are kept at the lowest level. With regard to this point, for example, the enlarged view of FIG. 1 shows a nozzle having a relatively wide air outlet port, but it is preferable to use a nozzle formed in a tapered shape toward the outlet port, so that air acts on the target surface of the liquid (such as the surface of the liquid facing the extending edge of the film) with pinpoint accuracy.

In FIG. 1, when air is blown, air is blown to act on the surface of the liquid of the upstream side (front side) elongating when the transfer film F comes into contact with the liquid. More specifically, air is blown to the surface of the liquid at the upstream side with respect to the action start point of the film holding mechanism 6. This is to more effectively elongate the transfer film F by removing the activating agent component K, which becomes a factor of blocking the elongation of the transfer film F, before the transfer film F elongates. With such air blow, the activating agent component K floating on the surface of the transfer liquid is conveyed to the portions between the side walls 22 and the film holding mechanism 6 while avoiding the action start points of the film holding mechanism 6.

In the embodiment of FIG. 1, the air blow from the two compressed air blow nozzles 102 is in a form of air blow somewhat opposite to the flow of the transfer liquid, but the two compressed air blow nozzles 102 may have a low performance (force of air blow) such that the activating agent component K (liquid film) on the surface of the liquid is moved to the side walls 22, and therefore, there is no chance that the air blow by the compressed air blow nozzles 102 blocks the flow of the transfer liquid L itself. By the way, the air blow opposite to the flow of the transfer liquid is preferably at an angle of about 90 degrees to about 120 degrees with respect to the direction of the flow of the liquid (downstream direction).

It is to be understood that, as also shown in FIG. 2, the air blow by the compressed air blow nozzle 102 may blown to the downstream along the flow of the flow of the transfer liquid L. Even in this case, however, it is preferably to blow air so as to move the activating agent component K on the surface of the transfer liquid to both side walls 22. More specifically, it is preferable to blow air so as to push the activating agent component K on the surface of the liquid floating in proximity to the side walls 22 from the position before the start point of the film holding mechanism 6 (chain conveyer 61) to the portions between the film holding mechanism 6 (chain conveyer 61) and the side walls 22. By the way, in this form of air blow in the downstream direction, the air blow is preferably blown at an angle of about 50 degrees to about 90 degrees with respect to the direction of the flow of the liquid (downstream direction).

As described above, the air blow of the elongation and extension reduction prevention mechanism 10 (removing means 101) is greatly different from the air blowing device 26 in that it is preferable not to cause the air to directly act on the transfer film F and in that a certain range of air blow direction is tolerated. In contrast, the air blowing device 26 causes the air to directly act on the surface of the transfer film F, and in addition, the air blow direction is set in one direction from the upstream to the downstream in view of the movement of the film.

Subsequently, standard of adjustment of the amount of air blow that is made when the air is blown by the compressed air blow nozzle 102 to prevent reduction of the elongation will be explained.

The applicant of the present application has conducted the following test to check the effects of air blow by the elongation and extension reduction prevention mechanism 10. In this test, 4000 liters of transfer liquid L (water) was put into the transfer tank 2 and is circulated, and continuous operation was performed while a conventional activating agent was applied to a conventional liquid pressure transfer film. When the transfer film no longer attached to the film holding mechanism 6 (was separated from the film holding mechanism 6), the operation was terminated, and the amount of used activating agent was checked. In this case, in the first time (the first attempt), the air blow for prevention of reduction of the elongation was not performed, and only in the second time (second attempt), the air blow for prevention of reduction of the elongation was performed. As a result, in the first attempt, when about 4 kg of activating agent was used in about five hours, the transfer film no longer attached to the film holding mechanism 6. The second attempt was carried out under the same condition except that water of the transfer tank 2 was replaced and the elongation and extension reduction prevention mechanism 10 was used to blow air as described above. In the second attempt, no change could be seen, and the transfer film continued to reach the film holding mechanism 6 always stably. Therefore, when continuous operation was performed for ten hours (about 8 kg of activating agent was used), the check (test) is terminated.

When judgment is made from this test, it is considered that, in the first attempt, the air blow for prevention of reduction of the elongation is not performed. Accordingly, the force of elongation of the transfer film F is gradually lost, and the elongation decreases, so that it considered that the transfer film no longer attached to the film holding mechanism 6. In the second attempt, the air blow for prevention of reduction of the elongation is always performed, so that the activating agent component K on the surface of the liquid is removed (the concentration of the surface of the liquid decreases), and the relationship is maintained such that the force of elongation of the film is stronger. Therefore, it is considered that the elongation of the transfer film F (arrival at the film holding mechanism 6) was always maintained.

Therefore, when the air blow for prevention of reduction of the elongation is performed, the following conclusion is obtained as the standard of adjustment of the amount of air blow. The air is to be blown so as to satisfy the following relationship: (the concentration of the activating agent in the transfer liquid+resisting force for blocking the elongation of the film due to the viscosity of the liquid and the liquid film due to the concentration of the activating agent on the surface of the transfer liquid)<the force of the elongation of the film.

In this case, the reason why not only the concentration (ratio) of the activating agent on the surface of the liquid but also the concentration of the transfer liquid are taken into consideration as the factors (conditions) for blocking the elongation of the transfer film F is because the concentration of the activating agent dissolved in the transfer liquid gradually increases as the transfer is repeatedly performed as described above. In this regard, the concentration of the activating agent in the transfer liquid can also be decreased or maintained at a low level by supplying the new water, and therefore, it is considered that it is also possible to prevent reduction of the elongation of the transfer film F by supplying the new water. By the way, in the present embodiment, this point is also taken into consideration, and therefore, the new water is supplied.

It should be noted that the removing means 101 in the elongation and extension reduction prevention mechanism 10 may not necessarily move the activating agent component K to the side walls 22 by blowing air, and other removing methods may also be employed. For example, a vacuum method may be employed, in which the activating agent component K on the surface of the liquid as well as the transfer liquid L are sucked mainly. In other words, in this case, a sucking nozzle is employed as the removing means 101.

In the present embodiment, the compressed air blow nozzle 102 of the elongation and extension reduction prevention mechanism 10 is provided together with the air blowing device 26, but the elongation and extension reduction prevention mechanism 10 may not be necessarily provided with the air blowing device 26, and when the transfer film F can be elongated to portions therearound by causing the elongation and extension reduction prevention mechanism 10 to blow air (remove the activating agent component K) or by performing the action of conveying (action of holding) with the flow of the liquid or the film holding mechanism 6, the air blowing device 26 may be omitted from the entire configuration of the liquid pressure transfer device 1.

Subsequently, the transfer film supply device 3 will be explained. For example, as shown in FIG. 1, the transfer film supply device 3 includes a film roll 31 made of the transfer film F wrapped as a roll, a heat roller 32 for heating the transfer film F pulled from the film roll 31, and a guide conveyer 33 for supplying the transfer film F to the transfer tank 2, and the transfer film F is supplied to the transfer tank 2 by guide rollers 34 by way of these members.

In this case, in the above explanation, transfer film F is successively fed to the transfer tank 2 from the film roll 31 wrapped as the roll. For example, the transfer film F may be cut into a rectangular shape in the first place, and the transfer films F thus cut may be fed to the transfer tank 2 one by one, and the object W can be pressed thereupon from above.

Subsequently, the activating agent applying device 4 will be explained. For example, the activating agent applying device 4 is provided at a stage subsequent to the heat roller 32 of the transfer film supply device 3, and includes a roll coater 41 for applying the predetermined activating agent to the transfer film F. In this case, in the embodiment as shown in FIG. 1, the activating agent is applied to the transfer film F, and thereafter, this is supplied to the transfer tank 2. Alternatively, the arrangement of the apparatus may be changed, and it is also possible to apply the activating agent to the transfer film F, which has been supplied to the transfer tank 2 and come into contact with the liquid, from above.

Subsequently, the object conveying device 5 will be explained. The object conveying device 5 places the object W into the transfer liquid L in an appropriate posture, and pulls out the object W from the transfer liquid L. Usually, in order to attach the object W with the transfer jig (which will be simply referred to as a jig J), the object conveying device 5 of the present embodiment also includes a conveyer 51 for performing an action of conveying and a jig holder 52. In other words, the object W is attached to the jig J in advance to perform the liquid pressure transfer, and the jig J is attached to and detached from the jig holder 52 to set the object W to the conveyer 51. Hereinafter, the conveyer 51 will be further explained.

For example, as shown in FIG. 1, the conveyer 51 has link bars 54 each passed horizontally between a pair of link chains 53 provided horizontally, and has jig holders 52 arranged on the link bars 54 with a predetermined interval. The conveyer 51 continuously immerses the object W as well as the jig J into the transfer liquid L and continuously removes the object W as well as the jig J out of the transfer liquid L. It should be noted that attachment of the object W (jig J) to the conveyer 51 at the liquid-immersion side and detachment of the object W (jig J) from the conveyer 51 at the liquid-exiting side after the transfer may be done automatically by a robot or may be done manually by an operator. In general, the conveying speed of the object W by the conveyer 51 (in particular, the speed in the immersion area P1) is set so as to be substantially in synchronization with the moving speed of the transfer film F on the surface of the liquid (i.e., the speed of the flow of the transfer liquid L).

The specific configuration of the conveyer 51 will be explained. For example, as shown in FIG. 1, this has such a structure that a liquid-exiting side wheel 57 is added to an ordinary triangular conveyer unit 55 of which conveying orbit is in an inverted triangle when it is seen from the side surface (the apex located at the lower side of the inverted triangle is a liquid-immersion side wheel 56), and is configured such that the object W is immersed into the liquid generally in a section between the liquid-immersion side wheel 56 and the liquid-exiting side wheel 57, and the liquid-leaving area P2 is set at a position different from the immersion area P1. More specifically, the liquid-leaving area P2 is set to be located clearly at the downstream side with respect to the immersion area P1 when it is seen in the top view.

By the way, in the aspect of conveying with only the conventional triangular conveyer unit 55, the object W is immersed into the liquid only at the apex at the lower side (the liquid-immersion side wheel 56), and the object W is immersed into the liquid for a very short time or momentarily, as it were. In contrast, in the present embodiment, a long time is ensured when the object W is immersed into the liquid although the object W is immersed into the liquid in a straight manner.

Therefore, in the present invention, a relatively long distance can be ensured from the immersion area P1 to the liquid-leaving area P2, and this is a preferable aspect of conveying for dividing the liquid surface residual film F' while the object W is immersed into the liquid and collecting the liquid surface residual films F' at the portions of both side walls 22.

Further, in the present embodiment, in the section from the liquid-immersion side wheel 56 to the liquid-exiting side wheel 57, the orbit of movement of the object W in the liquid is set substantially horizontally. The conveyer 51 has this kind of structure, and is further configured such that the conventional triangular conveyer unit 55 and the conventional straight conveyer 58 unit are connected by the liquid-exiting side wheel 57. These constituent unit members will be hereinafter explained.

Like the conventional configuration, the entire triangular conveyer unit 55 is configured to be inclinable about the liquid-immersion side wheel 56, serving as the center of rotation, corresponding to the lower side apex, and this enables the angle of the object W immersed into the liquid to be changed as necessary. By the way, in this case, the angle of immersion into the liquid is an angle at which the object W moves toward the surface of the transfer liquid L. For example, a setting range of about 15 degrees to about 35 degrees is assumed as this angle.

The straight conveyer unit 58 is also configured to be pivotable about the chain wheel 59 at the lower side, and has a so-called pantograph-shaped structure. This (the reason why the straight conveyer unit 58 is also configured to be pivotable) is because, even if the angle of the object W immersed into the liquid is changed by pivoting the triangular conveyer unit 55, the conveying length of the entire conveyer 51 (the entire length of the link chain 53) cannot be changed, and it is necessary to maintain the tension applied to the conveyer 51. In other words, the free pivoting end side of this is caused to function as a so-called tension pulley by pivoting the straight conveyer unit 58.

Figure 12:
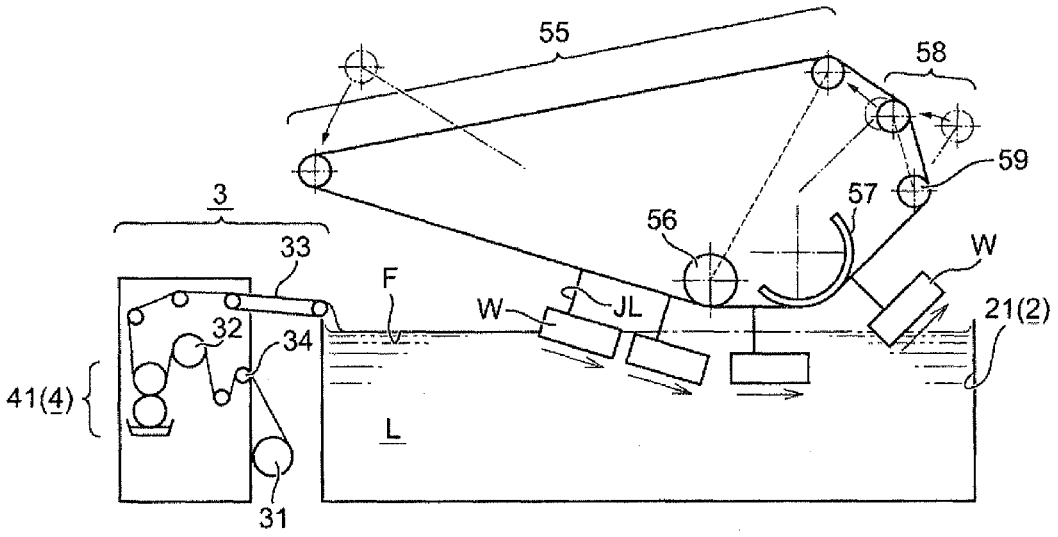
FIG. 12 is a side view illustrating an object conveying device made by connecting a triangular conveyer unit and a straight conveyer unit with a liquid-exiting side wheel, wherein a case where the angle of immersion into the liquid is relatively small is denoted with a solid line in (a), and a case where the angle of immersion into the liquid is relatively large is denoted with a solid line in (b).
Figure 12:
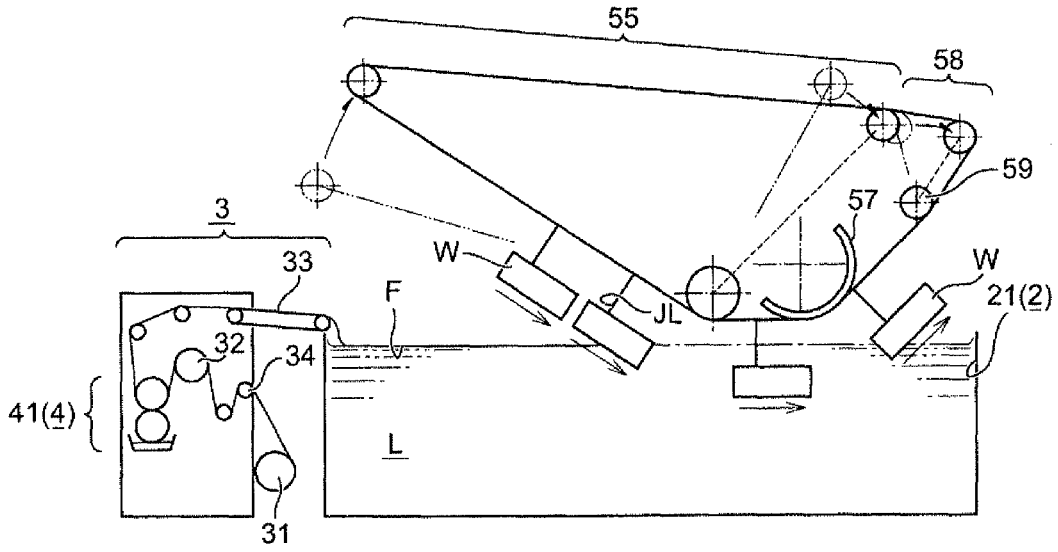

In this case, a solid line portion in FIG. 12(*a*) is a conveying orbit when the angle of immersion into the liquid is relatively small (for example, an angle of about 15 degrees when the object W is immersed into the liquid), and a solid line portion in FIG. 12(*b*) is a conveying orbit when the angle of immersion into the liquid is relatively large (for example, an angle of about 30 degrees when the object W is immersed into the liquid). By the way, in the present embodiment, a section from the liquid-exiting side wheel 57 to the pivoting center side of the straight conveyer unit 58 (the chain wheel 59) is set in a fixed state (only pivoting at the fixed position is allowed), and therefore, the angle of exiting from the liquid cannot be changed (set as fixed).

Although the liquid-exiting side wheel 57 is denoted as "wheel", the liquid-exiting side wheel 57 may not be necessarily a rotating member according to the link chain 53 running. For example, as shown in FIG. 12 above, the liquid-exiting side wheel 57 may be a guide member that comes into contact with the chain and smoothly guides the chain (so-called sliding contact).

The diameter of the liquid-exiting side wheel 57 is preferably the same as that of the liquid-immersion side wheel 56 or larger than that of the liquid-immersion side wheel 56. This is because when the liquid-exiting side wheel 57 is smaller, this results in a higher peripheral speed (rotation speed) at which the object W turns along the outside of the liquid-exiting side wheel 57 when the object W moves out of the liquid and, results in a greater change of the angle (the speed difference with respect to the transfer liquid L becomes excessive). More specifically, in this conveyer 51, the moving speed (chain running speed) at the link chain 53 portion to which the link bar 54 is attached is maintained at a constant level, and therefore, when the diameter (rotation radius) of the liquid-exiting side wheel 57 decreases, this results in a higher peripheral speed (rotation speed) at which the object W turns along the outside of the wheel and, results in a greater change of the angle.

Figure 13:
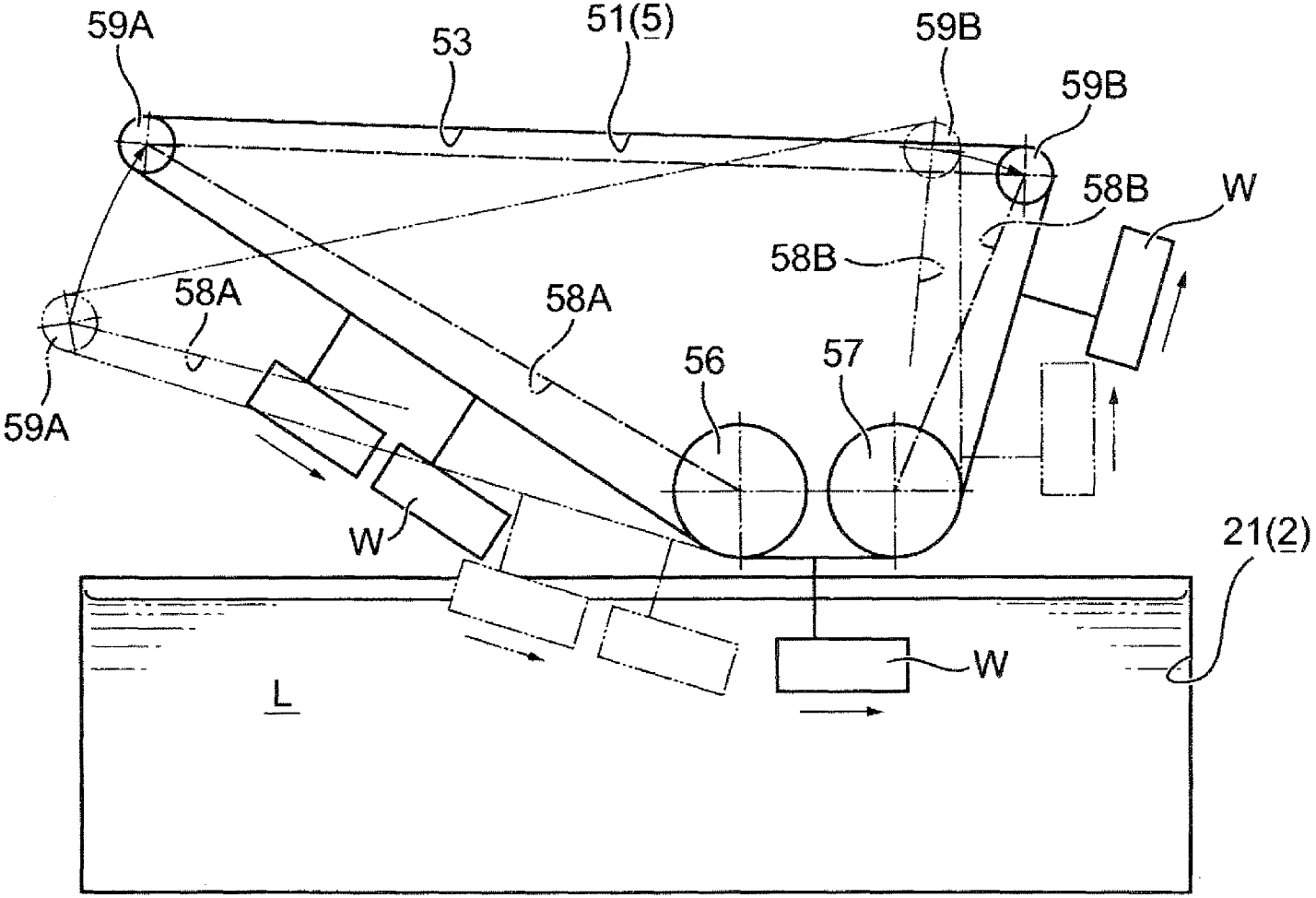
FIG. 13 is a side view illustrating the object conveying device in which an entire conveying orbit is formed in a rectangular shape in the state of view from the side surface, wherein the angle of immersion into the liquid and the angle of exiting from the liquid can be changed.

In the embodiment as shown in FIGS. 1 and 12 explained above, the angle of exiting from the liquid is fixed and unchangeable as described above. Alternatively, the angle of exiting from the liquid may be changeable. More specifically, for example, as shown in FIG. 13, this is a case where the entire conveying orbit is formed in a rectangular shape (in particular, trapezoid) when the conveyer 51 (link chain 53) is seen from the side surface. In this case, the liquid-immersion side wheel 56 and the liquid-exiting side wheel 57 are set in a fixed state (only pivoting at the fixed position is allowed), and the remaining two chain wheels 59A, 59B are formed to be pivotable with respect to the liquid-immersion side wheel 56 and the liquid-exiting side wheel 57, respectively. More specifically, straight conveyer units 58A, 58B at the liquid-immersion side and the liquid-exiting side provided adjacently to the liquid-immersion side wheel 56 and the liquid-exiting side wheel 57 are formed to be flexibly pivotable about the liquid-immersion side wheel 56 and the liquid-exiting side wheel 57.

It is to be understood that in the present embodiment, the conveying length of the entire conveyer 51 (the entire length of the link chain 53) cannot be changed, either. Therefore, when the angle of the object W when the object W is immersed into the liquid is changed, the straight conveyer unit 58B at the liquid-exiting side is also swung like a tension pulley, whereby the angle of exiting from the liquid is changed. Therefore, in the present embodiment, although the angle of exiting from the liquid is changeable, this is a change related to the angle of immersion into the liquid, and the angle of exiting from the liquid cannot be flexibly changed without any limitation. By the way, the solid line portion in FIG. 13 shows the aspect of conveying where the angle of immersion into the liquid is large and the angle of exiting from the liquid is small. On the other hand, the chain double-dashed line portion in FIG. 13 shows the aspect of conveying where the angle of immersion into the liquid is small and the angle of exiting from the liquid is large. By the way, regarding the specific angels, for example, the angle of immersion into the liquid can be changed from about 15 degrees to about 35 degrees, and the angle of exiting from the liquid can be changed from about 75 degrees to about 90 degrees.

Figure 14:
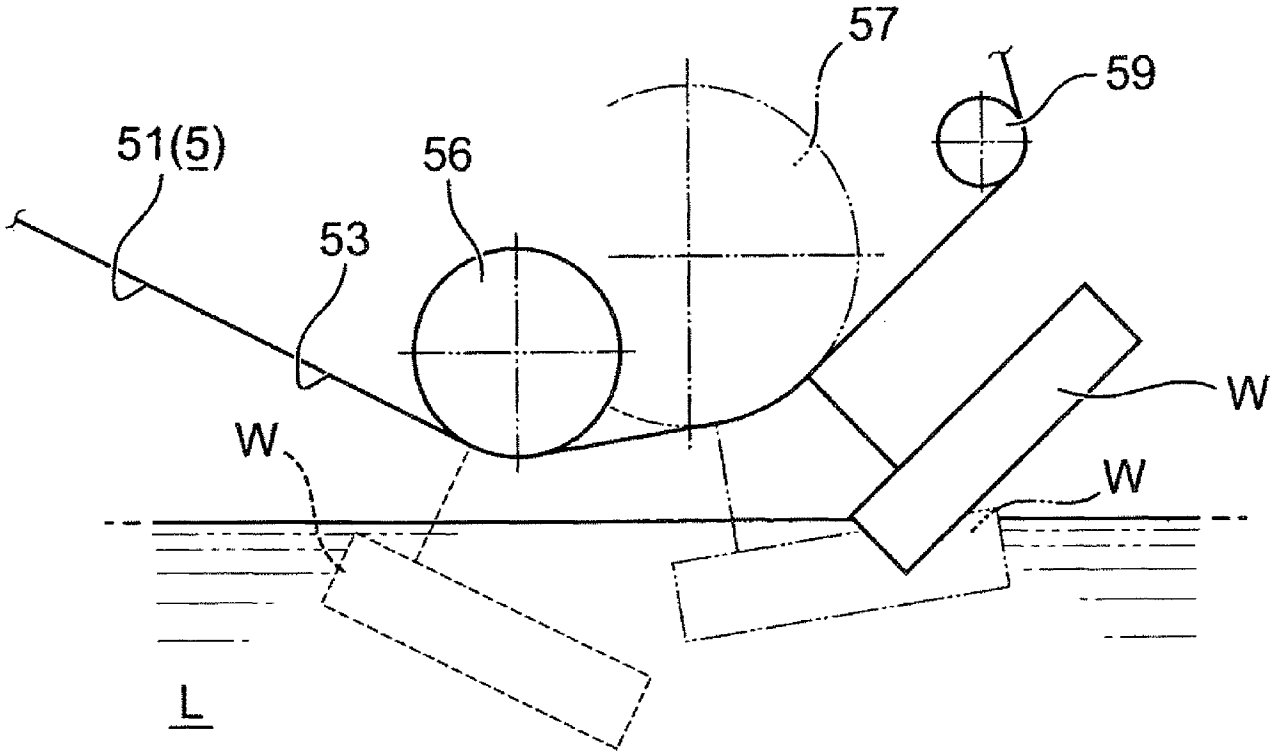
FIG. 14 is a partial side view illustrating the object conveying device in which the object is gradually moved upward in the transfer liquid in a section between a liquid-immersion side wheel and a liquid-exiting side wheel.

In the embodiment as shown in FIGS. 12, 13 and the like explained above, the object W is conveyed substantially horizontally in the liquid from the liquid-immersion side wheel 56 to the liquid-exiting side wheel 57, but the aspect of conveying the object W is not limited thereto. For example, as shown in FIG. 14, it may also be possible to employ a form of conveying so as to gradually move the object W upward in the above section. In this case, the object W is conveyed upward with an appropriate inclination angle (the angle of exiting from the liquid) while the object W is conveyed between both of the wheels. Therefore, when only the liquid-exiting side wheel 57 is gradually moved upward in the above section after the object W is immersed into the liquid, the angle at which the object W exits from the liquid can be gradually increased. Therefore, when the liquid-exiting side wheel 57 is configured to be able to move upward and downward flexibly in FIG. 13 explained above, the angle of exiting from the liquid can be changed with a higher degree of flexibility, and in some cases, the angle of exiting from the liquid can be changed without relying on the angle of immersion into the liquid at all.

Figure 15:
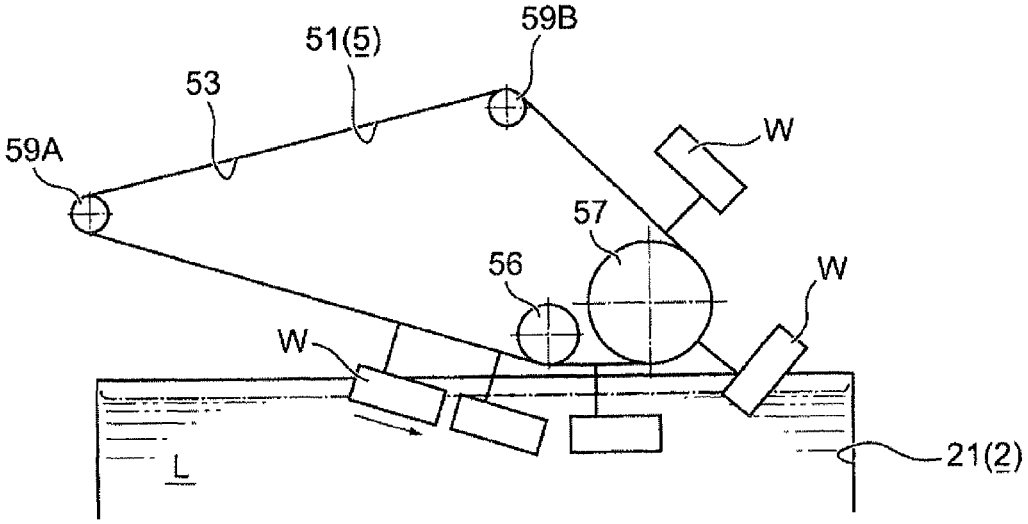
FIG. 15 is a side view illustrating the object conveying device in which, after the liquid-exiting side wheel, the object is conveyed to the liquid-immersion side in a folded manner.

For example, as shown in FIG. 15, the conveying orbit of the conveyer 51 may also be formed in a folded manner to the liquid-immersion side after the object W passes the liquid-exiting side wheel 57 (so-called overhang state). In this case, FIG. 15 shows that the object W having exited from the liquid is conveyed in the overhang manner after the object W is removed out of the liquid. However, when, e.g., the arrangement of the conveyer 51 with respect to the transfer tank 2 (transfer liquid L) is changed, the object W can be pulled up in the overhang state when the object W moves out of the liquid. More specifically, the object W can be pulled out of the liquid while the design surface S1 faces the upper side, i.e., the object W is in a reversed state.

It should be noted that it is an object of the conveyer 51 explained above to ensure a time and a distance to some extent between the immersion area P1 and the liquid-leaving area P2, but it may also be possible to make the conveyer 51 with only the conventional triangular conveyer unit 55. However, in this case, the jig leg JL as shown in FIG. 12 is set to have somewhat longer length, so that the object W sinks into the liquid relatively deeply, whereby a longer distance is preferably ensured from the immersion area P1 to the liquid-leaving area P2. It is to be understood that when the length of the jig leg JL is simply increased, this results in a higher peripheral speed at which the object W turns along the outside of the liquid-immersion side wheel 56 (the apex at the lower side of the triangular conveyer) and, results in a greater change of the angle. Therefore, it is necessary to determine, e.g., the overall aspect of conveying in view of this.

Figure 16:
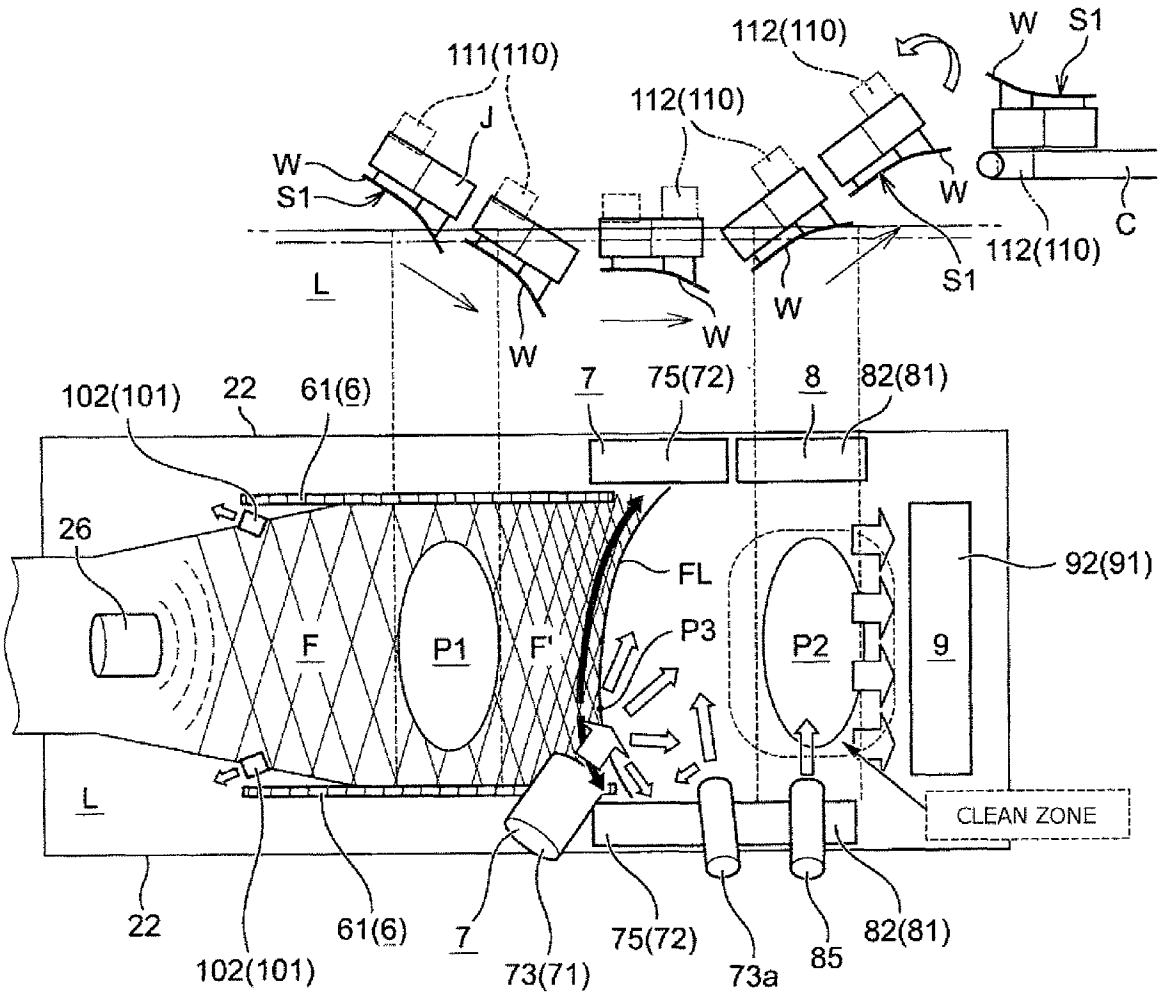
FIG. 16 is an explanatory diagram, corresponding to FIG. 1, illustrating and associating a transfer tank and an example of movement of the object by an object conveying device to which a robot is applied.

The object conveying device 5 is not limited to the conveyer 51 explained above. For example, as shown in FIG. 16, it is possible to apply a robot 110 (multi-joint robot, a so-called manipulator). In this case, the transfer tank 2 is also based on the form explained above, and while the object W is immersed into the liquid, the liquid surface residual film F' is divided and discharged from the transfer tank 2. It is to be understood that when the transfer liquid L and the liquid-leaving area P2 are cleaned and purified at a high level, it is more preferable to be provided with the liquid-leaving area cleaning mechanism 8, the design surface cleaning mechanism 9, the elongation and extension reduction prevention mechanism 10, the inclined plate 27, and the like.

In FIG. 16, reference numeral 111 indicating a broken line portion denotes a hand of a transfer robot for immersing the object W into the transfer liquid L, and the hand 111 holds the jig J that holds the object W in many cases. In the figure, reference numeral 112 indicating a chain double-dashed line portion denotes a hand of a handling robot for pulling the object W having been subjected to the transfer process from the liquid and placing the object W on a conveyer C for UV emission step, and in this case, the hand 112 also holds the jig J that holds the object W in many cases.

In the liquid pressure transfer (robot transfer) to which the robot 110 is applied, the posture of the object W can be changed more flexibly than the conveyer 51 explained above. Therefore, the angle of immersion into the liquid, the angle of exiting from the liquid, or the posture and the position in the liquid can be set with a higher degree of diversity and a higher degree of flexibility. In addition, it is possible to more flexibly set the speed when the object W is immersed into the liquid, the speed when the object moves horizontally in the liquid, and the speed when the object W is removed out of the liquid. It is also possible to provide multiple robots 110 at the right and left of the transfer tank 2 to alternately carry out the process from the transfer to the pulling up.

Further, the conveyer 51 can only pull up the object W in a straight manner along the conveyer 51 with the conveying orbit when the object W is removed out of the liquid, and as shown in FIG. 11 explained above, depending on, e.g., the state of the curve and the degree of projections and depressions of the object W (design surface S1), the design surface S1 may gradually move away from the overflow tank 92 (discharge port 93). In contrast, when the object W is pulled up by the robot 110, the object W can be moved to the front and the back or the object W can be pulled up while the object W is rotated so as to maintain a constant distance between the design surface S1 and the overflow tank 92 (discharge port 93) depending on, e.g., the state of the curve and the degree of projections and depressions of the object W, and using the design surface oppositely-separating flow from the design surface S1 to the overflow tank 92, it is possible to reliably clean the design surface S1 and eliminate the bubbles A on the surface of the liquid and the foreign substances in the transfer liquid and on the surface of the liquid. Therefore, precise transfer can be performed continuously, efficiently, and unattendedly.

In the robot transfer, by rotating (reversing), in the liquid, the design surface facing the surface of the liquid when the object W is immersed into the liquid, the object W can be pulled up in the reversed state in which the design surface S1 faces the upper side when the object W is removed out of the liquid. It is to be understood that the posture of the object W when the object W is removed out of the liquid may be as follows. It is also possible to pull up the object W from the liquid such that the design surface S1 is at about 90 degrees with respect to the surface of the liquid (an angle of about 90 degrees at which the object W exits from the liquid).

The liquid pressure transfer device 1 to which the collecting device (transfer tank 2) for the liquid surface residual film is applied is configured as described above. Hereinafter, while a method of transfer (aspect of transfer) with the liquid pressure transfer device 1 is explained, a method for collecting a liquid surface residual film will also be explained.

(1) Supply of Transfer Film

When the liquid pressure transfer is performed, first, the transfer film F is supplied to the transfer tank 2 storing the transfer liquid L. In this case, as described above, it is preferable to form a transfer pattern also having the surface protection function during the liquid pressure transfer (the top coating after the transfer is unnecessary), and therefore, the transfer film F is either a film having only a transfer pattern made of transfer ink formed on a water-soluble film or a film having a curable resin layer formed between a water-soluble film and a transfer pattern, and in particular, when a transfer film F having only the transfer pattern formed on the water-soluble film is used, it is preferable to apply a liquid curable resin composition as the activating agent.

In the present embodiment, when the transfer film F is supplied to the transfer tank 2, the activating agent component K becoming in a liquid film form on the surface of the transfer liquid L between the film holding mechanism 6 (chain conveyer 61) and the transfer film F and reducing elongation of the transfer film F is removed. In order to remove the activating agent K, for example, as shown in FIG. 1, air is blown from the compressed air blow nozzles 102 to the surface of the liquid that faces the extending edge of the transfer film F, whereby the activating agent component K accumulated (floating) there is pushed to portions between the film holding mechanism 6 and the side walls 22 while it moves around the action start point (front side) of the film holding mechanism 6. Therefore, on the surface of the liquid that faces the extending edge of the transfer film F, the activating agent component K is always removed, and therefore, the portions of both sides of the transfer film F (both side edge portions) reliably continue to reach the chain conveyers 61 serving as the film holding mechanism 6, and are conveyed to the immersion area P1 (transfer position) while a substantially constant elongation rate is maintained.

The activating agent component K pushed to the portions between the film holding mechanism 6 and the side walls 22 is preferably thereafter collected by introducing the activating agent component K into the overflow tanks 75 (discharge ports 76*a*). This is to continuously collect (discharge) the activating agent component K from the transfer tank 2, extend the transfer film F, and furthermore, continuously perform the precise liquid pressure transfer.

(2) Immersion of Object into the Liquid

As described above, after the transfer film F becomes transferrable on the surface of the transfer liquid L, for example, the objects W held by the conveyer 51 are successively immersed into the transfer liquid L in an appropriate posture (with the angle of immersion into the liquid). It is to be understood that this angle of immersion into the liquid can be changed as necessary according to the shape and projections and depressions of the object W (design surface S1).

In this case, in the present invention, the immersion area P1 is somewhat away from the liquid-leaving area P2 where the object W is thereafter pulled up from the liquid, and the object W is immersed in the transfer liquid L for a relatively long time. By the way, when the object W is immersed into the liquid, the object W is preferably conveyed substantially horizontally in the liquid.

As shown in FIG. 1, the transfer film F on the surface of the liquid is pierced, and a hole is formed therein, when the object W is immersed into the liquid. The film remaining on the surface of the liquid is the liquid surface residual film F that is not used for the transfer. Therefore, in the present invention, the liquid surface residual film F' is reliably collected as soon as possible after the transfer so that the liquid surface residual film F' does not reach the liquid-leaving area P2 at the downstream. Hereinafter, this aspect of collecting will be explained.

(3) Dividing of Liquid Surface Residual Film

When the liquid surface residual film F' is collected, first, the liquid surface residual film F' is divided in the direction of the flow of the liquid at the downstream side with respect to the immersion area P1 but at the upstream side with respect to the liquid-leaving area P2, and as shown in FIG. 1, this is done by dividing the liquid surface residual film F' having been used for the transfer by blowing air thereto. Thereafter, the liquid surface residual films F' divided by the air are gradually conveyed to come closer to the both side walls 22 by, e.g., air blow and the flow of the liquid. As shown in FIG. 3, the liquid surface residual films F' divided by the air are collected there by the overflow tanks 75 provided on the both side walls 22.

(4) Collection of Liquid Surface Residual Film

Then, in the present invention, in order not to block collection of the liquid surface residual films F', the action of holding the film by the film holding mechanism 6 (chain conveyer 61) is cancelled in the overflow tank 75 (discharge port 76), but the action of holding the film by the film holding mechanism 6 (chain conveyer 61) is not to be cancelled before the overflow tank 75 (upstream side). For example, as shown in FIG. 7(*a*), the action of holding the film is preferably configured to somewhat act on the discharge port 76 (overlap state). This is to cause the chain conveyer 61 to reliably hold the liquid surface residual film F' to the overflow tank 75. Therefore, the liquid surface residual films F' do not pull the transfer film F at the transfer position, and flow at the portions of the overflow tanks 75 so as to curl around the sprockets 63 at the end of the chain conveyers 61. Then, the liquid surface residual films F' are dropped into and collected in the overflow tanks 75.

In proximity to the edge of the dividing line FL, the liquid surface residual films F' are moved closer to the both side walls 22 by the air blow and the flow of the liquid while the liquid surface residual films F' are gradually dissolved little by little and separated as described above. Therefore, when the liquid surface residual films F' are collected, the entire block portion at the dividing line FL and the foreign substances separated at the dividing line FL are preferably collected at two stages. The configuration suitable for this is the blocking means 77 provided in a middle portion of the discharge port 76 of the overflow tank 75. In other words, due to the existence of the blocking means 77, the liquid surface residual film F' is collected at two stages before and after the blocking means 77 even in the one overflow tank 75. More specifically, as shown in FIGS. 3 and 8, the entire block at the dividing line FL is guided to the upstream side with respect to the blocking means 77 (the screen board 78 or the in-tank blocking body 79), i.e., at the side before the blocking means 77, and is collected by the first stage at the front side, whereas the separated foreign substances at the dividing line FL are collected by the second stage at the rear side with respect to the blocking means 77.

The blocking means 77 is provided to narrow the flow rate guide range of the discharge port 76, and therefore, the blocking means 77 also performs control to weaken the flow rate after the action of holding the film is cancelled.

The liquid surface residual films F' thus divided by the air are reliably collected in the overflow tanks 75 without giving adverse effects on the transfer position (immersion area P1).

In this case, the screen board 78 and the in-tank blocking body 79 as shown in FIGS. 3 and 8 may be employed as the blocking means 77. When the in-tank blocking body 79 is used, the in-tank blocking body 79 can be fixed by just dropping the in-tank blocking body 79 into the overflow tank 75, and the in-tank blocking body 79 is preferable in that the position setting with respect to the discharge port 76 and the adjustment of the collection ratio at the two stages before and after the blocking means 77 can be made easily by sliding the in-tank blocking body 79 to the front or the back It is to be understood that this kind of collection of the liquid surface residual film F' is completed at the upstream side with respect to the liquid-leaving area P2.

(5) Cleaning of Liquid-Leaving Area is Cleaned (at the Side of the Decoration-Unnecessary Surface)

In the present embodiment, along with such collection of the liquid surface residual film F', the liquid-leaving area cleaning mechanism 8 is used to clean the liquid-leaving area P2. In particular, the side of the decoration-unnecessary surface S2 is cleaned. This will be hereinafter explained. The liquid-leaving area cleaning mechanism 8 is to move, away from the liquid-leaving area P2, the foreign substances in the transfer liquid and on the surface of the liquid and the bubbles A on the surface of the liquid in the liquid-leaving area P2, and discharge the foreign substances and the bubbles A to the outside of the tank. In order to do this, for example, as shown in FIG. 3, the overflow tanks 82 are provided at both of the right and left side walls 22 of the liquid-leaving area P2, and the side oppositely-separating flow flowing from the liquid-leaving area P2 to the overflow tanks 82 is formed. Therefore, mainly, the foreign substances in the liquid such as the film residues are prevented from coming closer to the liquid-leaving area P2, and the foreign substances are collected.

Further, in the present embodiment, as shown in FIGS. 1 to 3, the air blowing device 85 is provided above one of the side walls 22 of the transfer tank 2 (above the overflow tank 82), and the air is blown through the liquid-leaving area P2 to the overflow tank 82 at the opposite side. With this air blow, the bubbles A and the foreign substances generated on the surface of the liquid in the liquid-leaving area P2 (at the side of the decoration-unnecessary surface S2) are conveyed to and collected in the overflow tank 82. For this reason, it is preferable to form the flow rate increase brim 84 in the overflow tank 82 to increase the flow rate (introduction speed) in proximity to the surface of the liquid.

When the side oppositely-separating flow is formed, it is preferable to use some of new water.

(6) Cleaning of Design Surface (at the Side of the Design Surface)

In addition, in the present embodiment, the design surface cleaning mechanism 9 is provided to clean the side of the design surface S1 of the liquid-leaving area P2. Therefore, when the object W is pulled up, the mechanism further cleans the design surface S1 of the object W that is coming out of the liquid, and moves, away from the design surface S1, the bubbles A on the surface of the liquid that are generated by the drips dropped from the object W (jig J) pulled up previously and the foreign substances in the transfer liquid and on the surface of the liquid, thus eliminating the bubbles A and the foreign substances from the liquid-leaving area P2. The mechanism will be hereinafter explained.

The design surface cleaning mechanism 9 cancels, as much as possible, the flow curling around to the design surface that is caused because it usually faces the downstream side while the object W is removed out of the liquid, and prevents the foreign substances from coming closer to the design surface S1. More specifically, as shown in FIGS. 1 and 2, the overflow tank 92 is provided in the liquid-leaving area P2, and this forms the design surface oppositely-separating flow made of new water to the object W (design surface S1) that is coming out of the liquid. In this case, in the overflow tank 92, it is preferable to form the flow rate increase brim 94, and it is preferable to increase the flow rate (introduction speed) in proximity to the surface of the liquid (see FIGS. 3 and 10).

When the object W (design surface S1) moves away from the overflow tank 92 serving as the oppositely-separating flow forming means 91 as the object W is removed out of the liquid, for example, the design surface oppositely-separating flow is to be strengthened by increasing the flow rate by gradually bringing the overflow tank 92 to the object W and reducing the water level (liquid level) of the overflow tank 92 (see FIG. 11).

By the way, when a manipulator is used as the object conveying device 5, it is preferable to remove the object W out of the liquid by controlling the orbit of the object W removed out of the liquid, so as to maintain a constant distance between the object W and the overflow tank 92.

In this case, the transfer liquid L collected by the overflow tanks 82, 92 is provided for recycled use by removing the foreign substances.

Further, in the present embodiment, the inclined plates 27 are installed at the bottom portion of the transfer tank 2, and the inclined plates 27 use the slow flow of the liquid caused by circulating-returning flow in the bottom portion of the transfer tank 2 and the flow of the liquid caused by substantially horizontal movement of the object W in the liquid (above the inclined plates 27) to capture the foreign substances accumulated in the transfer liquid L. Therefore, the inclined plates 27 perform the action of cleaning the transfer liquid L, but when the recycled use of the transfer liquid L is considered, it can be said that this indirectly contributes to cleaning of the liquid-leaving area P2. Therefore, in the present embodiment, high degree of cleanness can be achieved in the liquid-leaving area P2 using the liquid surface residual film collecting mechanism 7, the liquid-leaving area cleaning mechanism 8, the design surface cleaning mechanism 9, inclined plate 27, and the like.

By the way, in the conventional liquid pressure transfer in which the top coating is applied after the liquid pressure transfer and the surface of the transfer pattern is protected, water-cleaning and the like is performed after the liquid pressure transfer, so that the water-soluble film attached to the object W (design surface S1) is removed, and thereafter, the top coating is applied. Therefore, the foreign substances such as film residues attached to the design surface S1 during the transfer do not immediately result in defectiveness. However, even in the conventional liquid pressure transfer as described above, maintaining a high level of cleaning in the liquid-leaving area P2 and a high degree of cleanness of the transfer liquid L is advantageous in that the precise liquid pressure transfer can be performed. The technical concept of the present embodiment is also preferable in the conventional liquid pressure transfer.

(7) Removal of Object Out of Liquid

The object W is pulled up from the liquid-leaving area P2 where a high degree of cleanness is achieved as described above, and therefore, the foreign substances and the bubbles A hardly attach to the design surface S1 (reduction of defective rate). On the other hand, the angle of exiting from the liquid when the object W is pulled out of the transfer liquid L can be changed as necessary.

In the transfer liquid L (in the conveying orbit in the section from the liquid-immersion side wheel 56 to the liquid-exiting side wheel 57), the object W is preferably conveyed substantially horizontally. This is to avoid applying stress to the design surface S1 caused by the angle change and excessive speed of the object W, during the rotation operation when the object W is in the transfer liquid L and when the object W is removed out of the liquid.

(8) Curing processing of Decorative Layer

The object W pulled up from the transfer liquid L is thereafter subjected to the processing of curing the transfer pattern (decorative layer). In this case, active energy rays such as ultraviolet rays are emitted to the object W (see FIG. 17(*c*)), and at this occasion, half-dissolved PVA is still attached to the design surface S1 of the object W. Other than the above emission of the active energy rays, heating may be another method for curing the transfer pattern (decorative layer). Alternatively, both of the emission of the active energy rays and the heating may be performed to cure the transfer pattern (decorative layer). By the way, a recitation, "emission of active energy rays and/or heating", in the claims means performing one of or both of these curing processing.

Thereafter, the PVA is removed from the object W (detachment of the film) with water-cleaning and the like, and the object W is dried. At this point, the series of operation is completed. It should be noted that, in the present embodiment, the transfer pattern (decorative layer) is already cured, and therefore, it is not necessary to apply the top coating after the drying, but it may also be possible to thereafter perform the top coating in addition.

(9) Transfer when Object has Opening Portion in Design Surface

Figure 17:
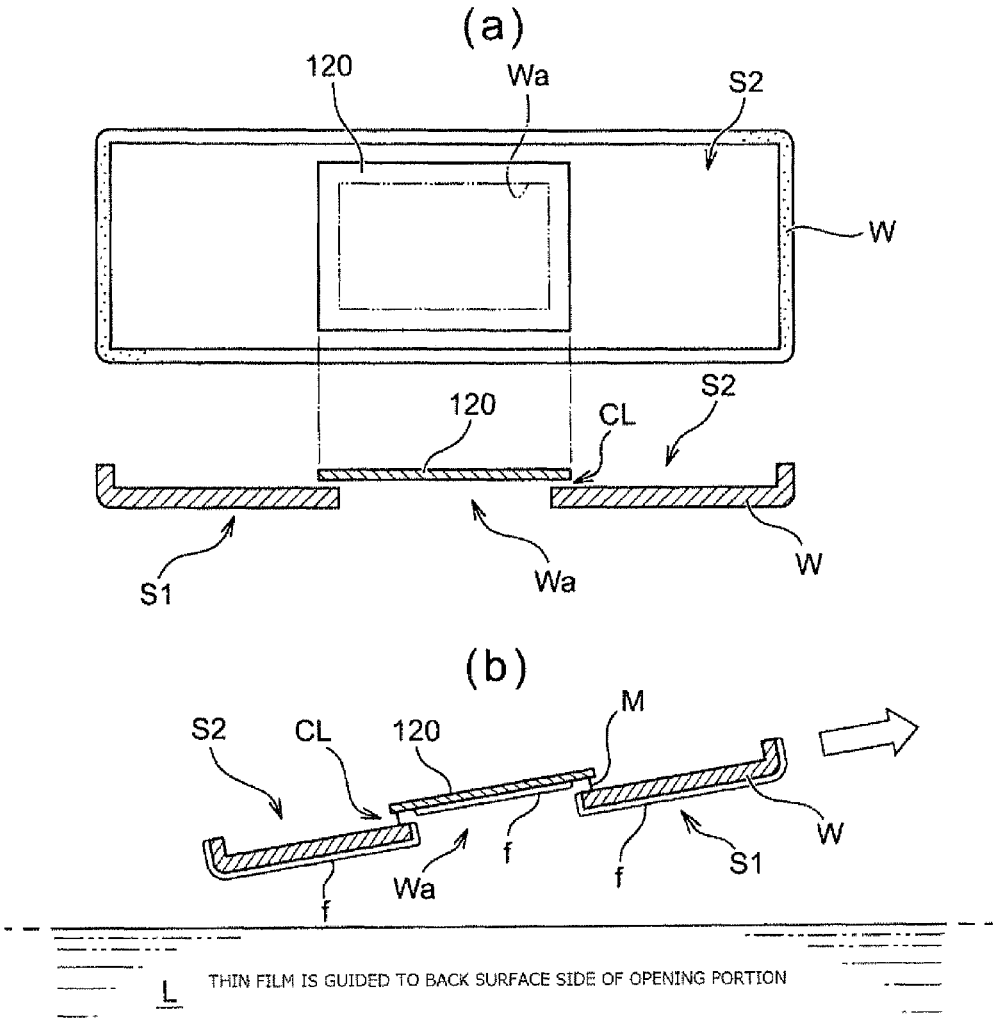
FIG. 17 includes a rear view and sectional view (a) illustrating an object having an opening portion in the design surface wherein a thin film derivative is provided with a clearance at the back surface side of this opening portion, and explanatory diagrams (b), (c) illustrating liquid pressure transfer and ultraviolet ray emission with the thin film derivative.

Subsequently, a preferred aspect of transfer where the object W has an opening portion Wa in the design surface S1 will be explained. For example, as shown in FIG. 17(*a*), such object W is preferably subjected to the transfer process (the object W is immersed into the transfer liquid L) with thin film derivative 120 arranged with an appropriate clearance CL at the back side of the opening portion Wa (decoration-unnecessary surface S2). This is because a thin film M may be originally formed on the design surface S1 on the front side, but with the thin film derivative 120, the thin film M is formed between the opening portion Wa and the thin film derivative 120 (clearance CL) as shown in FIG. 17(*b*).

In this case, the reason (details) why the thin film M, which is formed at the side of the design surface S1 in an ordinary case, can be formed in the clearance CL by using the thin film derivative 120 will be explained. The thin film M is generally similar to soap bubble, and therefore, this has a property of forming a film in such a manner as to decrease the size of area (surface area) of the film (Fermat's principle). Therefore, when the thin film derivative 120 is provided such that the size of area of all periphery of the clearance CL (this will be referred to as separation all peripheral area size) is less than the size of area of the opening portion Wa (opening portion size), the thin film M can be guided to the side of the clearance CL (the side of the decoration-unnecessary surface S2).

Therefore, for example, as also shown in FIG. 17(*a*), the thin film derivative 120 is formed to be in substantially the same size as the opening portion Wa or formed to be in a size slightly larger than the opening portion Wa when the opening portion Wa is seen from the front. This is a configuration for reliably forming the clearance CL in the entire periphery of the opening portion Wa.

When the thin film derivative 120 is located at the back side of the opening portion Wa, the thin film derivative 120 may be attached to the jig J, or the thin film derivative 120 may be directly attached to the object W using the back surface of the object W (assembling structure as assembly).

By the way, for example, as shown in FIG. 17(*c*), the thin film derivative 120 is preferably located at the side of the decoration-unnecessary surface S2 until the curing processing of the decorative layer is completed. No problem would be caused even if the thin film M breaks when the object W is removed out of the liquid or when the object W is subjected to the curing processing, and this is because the thin film M is formed at the side of the decoration-unnecessary surface S2 of the object W, and it is less likely to generate the bubbles A with broken residuals even at the side of the design surface S1 if the thin film M breaks.

For example, when the robot transfer is performed or when the object W is pulled up from the liquid in the overhang state even if the conveyer 51 is applied, the object W can be pulled up in the reversed state in which the design surface S1 face the upper side, and therefore, even if the object W has the opening portion Wa in the design surface S1, the liquid pressure transfer can be performed without using such thin film derivative 120 (it is considered that the bubbles A are less like to attach to the design surface S1). This is because while the object W is pulled up in the reversed state, the liquid attached to the object W (design surface S1) naturally flows to the back side corresponding to the lower side due to the gravity, and even if the bubbles A are generated with the broken residuals, it is considered that the bubbles A also move around to the side of decoration-unnecessary surface S2 according to the above flow.

Figure 18:
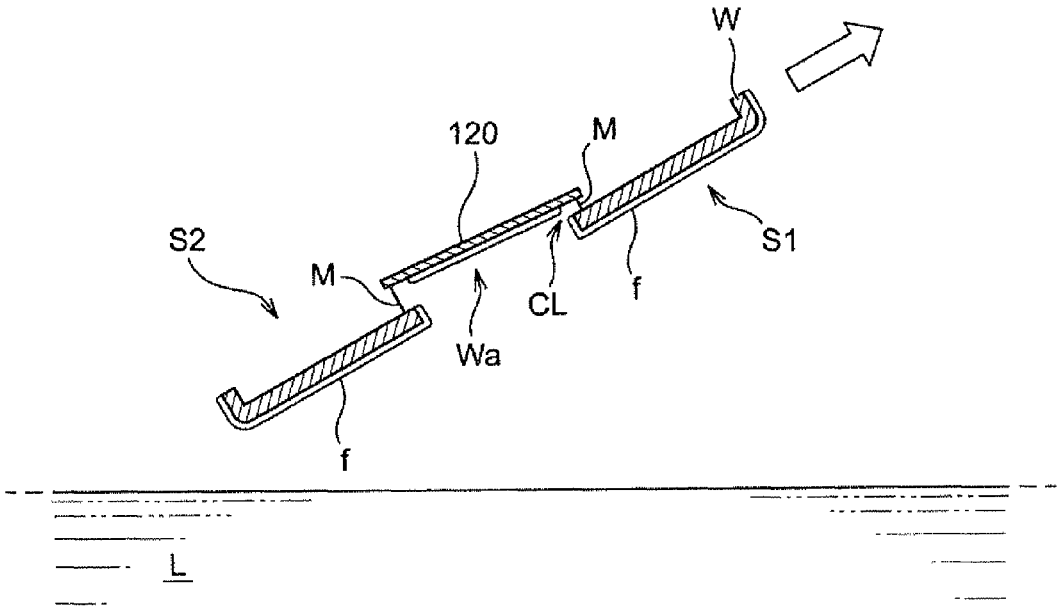
FIG. 18 is an explanatory diagram illustrating an embodiment in which, when a thin film derivative is provided on an object, a clearance with the opening portion is not constant but is different on the entire periphery.
Figure 19:
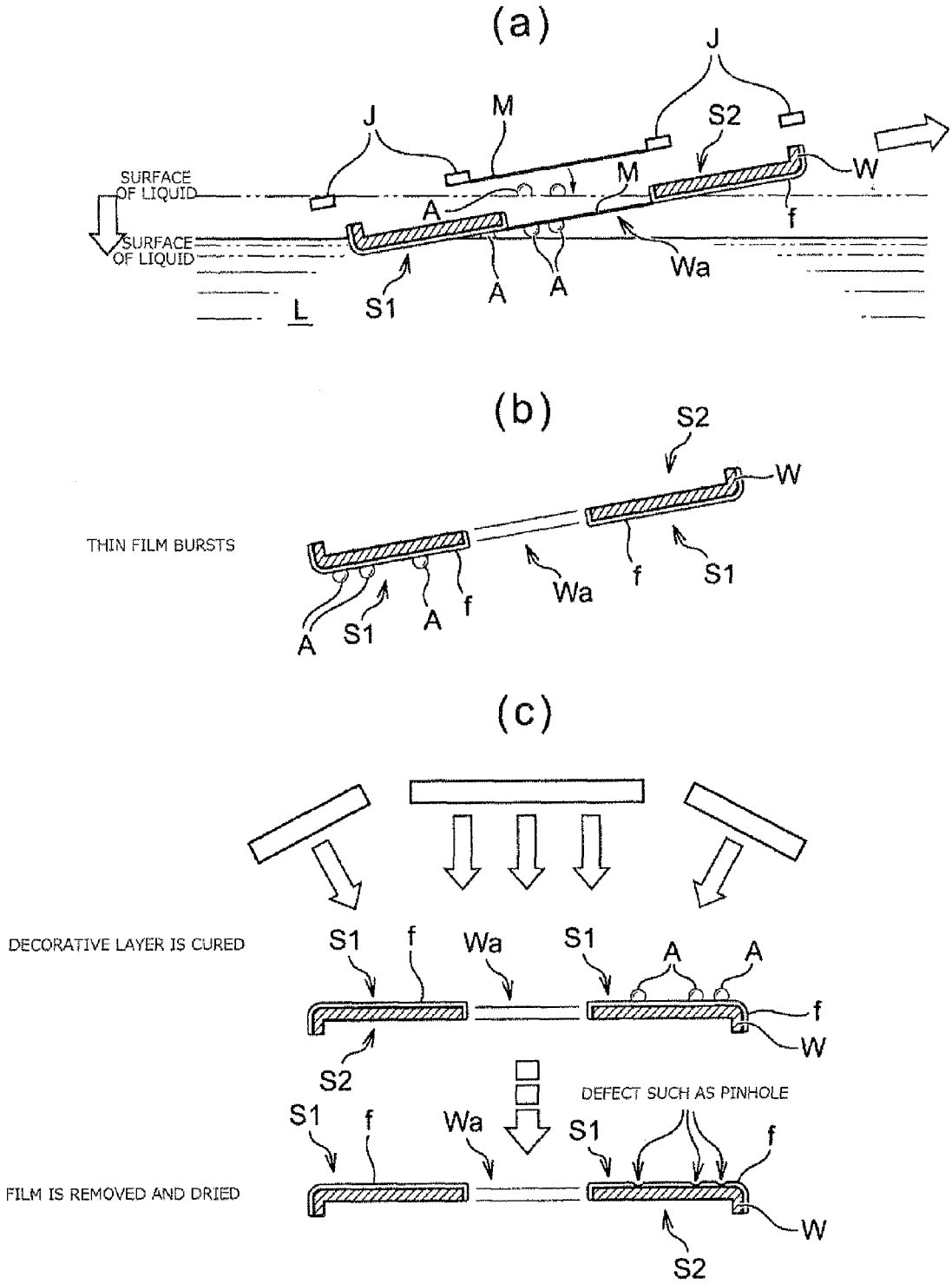
FIG. 19 is an explanatory diagram illustrating a case where during liquid pressure transfer, not only a transfer pattern but also a surface protection layer are formed, and thereafter, the decorative layers are cured by ultraviolet ray emission and the like, and the explanatory diagram shows how bubbles attach to the design surface during the liquid pressure transfer and how the ultraviolet rays are emitted in this state.

Further, the above clearance CL may not be necessarily formed constantly on the entire periphery of the opening portion Wa. For example, as shown in FIG. 18, the above clearance CL can be gradually decreased (in this case, the thin film derivative 120 is installed such that the clearance CL gradually widens toward the lower side of the object W removed out of the liquid). In this case, escaping air can be easily guided between the object W and the thin film derivative 120 when the object W is immersed into the liquid for the transfer process, and the precise liquid pressure transfer can be performed, and the liquid can be discharged and dried quickly after the object W is removed out of the liquid.

INDUSTRIAL APPLICABILITY

In the present invention, during the liquid pressure transfer, the liquid surface residual film not used for the transfer and floating on the surface of the liquid is collected quickly and reliably after the object is immersed into the liquid, and the present invention is suitable for the liquid pressure transfer for forming a transfer pattern having the surface protection function during the transfer process (liquid pressure transfer that does not require the top coating), but the present invention is also applicable to the conventional liquid pressure transfer for forming a transfer pattern during the transfer process and protecting the surface by applying the top coating after the transfer process.

It should be noted that the present invention is a technical concept for reliably collecting the liquid surface residual film F' with a simple structure as described above, the elongation and extension reduction prevention mechanism 10 for removing the activating agent component K flowing and accumulating on the surface of the transfer liquid L as the object comes into contact with the transfer film F and forming the film so as to block the elongation of the film is also an extremely revolutionary new technical concept.

REFERENCE SIGNS LIST

1 liquid pressure transfer device
2 transfer tank
3 transfer film supply device
4 activating agent applying device
5 object conveying device
6 film holding mechanism
7 liquid surface residual film collecting mechanism
8 liquid-leaving area cleaning mechanism
9 design surface cleaning mechanism
10 elongation and extension reduction prevention mechanism
2 transfer tank
21 processing tank
22 side wall
23 circulating pipe path
24 cleaning device
25 circulating pump
26 air blowing device
27 inclined plate
28 water intake opening
29 frame
30 frame
3 transfer film supply device
31 film roll
32 heat roller
33 guide conveyer
34 guide roller
4 activating agent applying device
41 roll coater
5 object conveying device
51 conveyer
52 jig holder
53 link chain
54 link bar
55 triangular conveyer unit
56 liquid-immersion side wheel
57 liquid-exiting side wheel
58 straight conveyer unit
58A straight conveyer unit
58B straight conveyer unit
59 chain wheel
59A chain wheel
59B chain wheel
110 robot (multi-joint robot)
111 hand (transfer robot)
112 hand (handling robot)
120 thin film derivative
6 film holding mechanism
61 chain conveyer
62 chain
63 sprocket
64 guide body
65 guide body
7 liquid surface residual film collecting mechanism
71 dividing means
72 discharge means
73 air blowing device
73*a* auxiliary air blowing device
73*b* auxiliary air blowing device
75 overflow tank
75*a* auxiliary overflow tank
76 discharge port
76*a* discharge port
77 blocking means
78 screen board
79 in-tank blocking body
79*a* dam action unit
79*b* foot unit
8 liquid-leaving area cleaning mechanism
81 discharge means
82 overflow tank
83 discharge port
84 flow rate increase brim
85 air blowing device
9 design surface cleaning mechanism
91 oppositely-separating flow forming means
92 overflow tank
93 discharge port
94 flow rate increase brim
95 sucking nozzle
10 elongation and extension reduction prevention mechanism
101 removing means
102 compressed air blow nozzle
A bubble
C conveyer (for UV emission step)
CL clearance
F transfer film
FL dividing line
F' liquid surface residual film
f transferred decorative layer
J jig
JL jig leg
K activating agent component
L transfer liquid
M thin film
W object
Wa opening portion
P1 immersion area (transfer position)
P2 liquid-leaving area
P3 dividing start point
S1 design surface
S2 decoration-unnecessary surface

The invention claimed is:

1. A method for collecting a liquid surface residual film for liquid pressure transfer comprising, in which a transfer film made by forming at least a transfer pattern on a water-soluble film in a dried state is supported in a floating manner on a surface of a liquid in a transfer tank, and an object is pressed on the transfer film from above, whereby the transfer pattern is transferred onto the object using a liquid pressure generated thereby, wherein the liquid surface residual film is not used for the transfer and floats on the surface of the liquid after the object is immersed into the liquid, wherein when the object immersed into the liquid is removed out of the transfer liquid, the object is pulled up from a liquid-leaving area at a downstream side that is different from an immersion area, the transfer tank includes a film holding mechanism, provided at inner sides of both right and left side walls, for coming into contact with and holding both sides of the transfer film supplied to the transfer tank and conveying the transfer film to at least the immersion area where the transfer is performed, when the liquid surface residual film, that is no longer needed after the transfer, is collected, the liquid surface residual film is split in a longitudinal direction of the transfer tank from when the object is immersed into the transfer liquid to when the object is removed from the transfer liquid, and the divided liquid surface residual films are moved closer to the both side walls of the transfer tank, and at the side wall portions, an action of holding the film by the film holding mechanism is cancelled, and from this cancelled portion, the divided liquid surface residual films are discharged out of the transfer tank.

2. The method for collecting a liquid surface residual film for liquid pressure transfer according to claim 1, wherein the liquid surface residual film is divided using air blown to the liquid surface residual film on the surface of the transfer liquid.

3. The method for collecting a liquid surface residual film for liquid pressure transfer according to claim 2, wherein the liquid pressure transfer applied to the object is performed by either applying a transfer film made by forming only a transfer pattern to a water-soluble film in a dried state and using a liquid curable resin composition as an activating agent, or applying a transfer film having a curable resin layer between a water-soluble film and a transfer pattern as a transfer film, and using the liquid pressure transfer, a transfer pattern also having a surface protection function is formed on the object, and this is cured by emission of an active energy ray and/or heating after the transfer.

4. The method for collecting a liquid surface residual film for liquid pressure transfer according to claim 2, wherein the object is conveyed substantially horizontally in a section from the immersion area to the liquid-leaving area in the transfer liquid.

5. A method for transferring liquid pressure, wherein in a method in which a transfer film made by forming at least a transfer pattern on a water-soluble film in a dried state is supported in a floating manner on a surface of a liquid in a transfer tank, and an object is pressed on the transfer film from above, whereby the transfer pattern is transferred onto the object, when collecting a liquid surface residual film not used for the transfer and floating on the surface of the transfer liquid after the object is immersed into the liquid, the liquid surface residual film is collected using the method for collecting the liquid surface residual film according to claim 2, and the liquid surface residual film is discharged out of the transfer tank.

6. The method for transferring liquid pressure according to claim 5, wherein while the object is held by a manipulator, a series of conveyance from immersion into the liquid to removal from the liquid is performed, at a downstream side of the liquid-leaving area, a third overflow tank is provided to form a design surface oppositely-separating flow which flows from the design surface side of the object being pulled up from the transfer liquid to a further downstream side of the transfer tank, and when the object is pulled up from the transfer liquid, the object is pulled up while a substantially constant distance is maintained between the design surface and the third overflow tank by moving the object held by the manipulator to a front and a back and rotating the object held by the manipulator, in accordance with a state of curve and a degree of projection and depression of the design surface.

7. The method for transferring liquid pressure according to claim 5, wherein when the object has an opening portion in the design surface, the liquid pressure transfer is performed by arranging a thin film derivative on a surface opposite to the design surface of the opening portion, so that a thin film made of a water-dissolved material of the water-soluble film is formed on the surface opposite to the design surface of the opening portion.

8. The method for collecting a liquid surface residual film for liquid pressure transfer according to claim 2, wherein at a downstream side of the liquid-leaving area, a design surface oppositely-separating flow, which flows from the design surface side of the object being pulled up from the transfer liquid to a further downstream side of the transfer tank, is formed in proximity to the surface of the liquid, and a bubble on the surface of the transfer liquid and a foreign substance accumulated in the liquid are moved away from the design surface of the object that is removed out of the liquid and are discharged out of the transfer tank.

9. The method for collecting a liquid surface residual film for liquid pressure transfer according to claim 8, wherein the design surface oppositely-separating flow is formed by a third overflow tank provided at the downstream side of the liquid-leaving area, and in a discharge port serving as a liquid collecting port of the third overflow tank, a flow rate increase brim is formed to increase a flow rate of the transfer liquid introduced into the third overflow tank.

10. The method for collecting a liquid surface residual film for liquid pressure transfer according to claim 9, wherein the third overflow tank for forming the design surface oppositely-separating flow is formed to be movable in a longitudinal direction of the transfer tank, and even when the position of the object is changed to a front or a back according to operation of removing the object out of the liquid, a substantially constant distance is maintained between the design surface of the object and the third overflow tank.

11. The method for collecting a liquid surface residual film for liquid pressure transfer according to claim 9, wherein the following elements are arranged to be movable in the longitudinal direction of the transfer tank:

an end termination portion of the action of holding the film by the film holding mechanism;

first overflow tanks for collecting the divided liquid surface residual films;

second overflow tanks for forming the side oppositely-separating flow in the liquid-leaving area and air blowing device for pushing the bubble and the foreign substance on the surface of the liquid in the liquid-leaving area to the second overflow tanks; and the third overflow tank for generating the design surface oppositely-separating flow.

12. The method for collecting a liquid surface residual film for liquid pressure transfer according to claim 2, wherein when the divided liquid surface residual films are collected by the both side wall portions of the transfer tank, first overflow tanks provided at both side wall portions are applied, and the first overflow tanks include a blocking device, for blocking collection of the liquid, at a portion of a discharge port for collecting the liquid surface residual film, so that the liquid surface residual films are collected from portions before and after the blocking device.

13. The method for collecting a liquid surface residual film for liquid pressure transfer according to claim 12, wherein the film holding mechanism is provided such that an end termination portion of the action of holding the film is arranged to somewhat overlap with the first overflow tanks for collecting the liquid surface residual film in a state of view from a side surface, so that a contact holding state of the mechanism for coming into contact with and holding the both sides of the film is maintained until the liquid surface residual film reaches the first overflow tanks.

14. The method for collecting a liquid surface residual film for liquid pressure transfer according to claim 12, wherein at both right and left sides of the liquid-leaving area from which the object is removed out of the transfer liquid, a side oppositely-separating flow flowing from the liquid-leaving area to the both side walls of the transfer tank is formed in proximity to the surface of the liquid, and a foreign substance accumulated in the transfer liquid and on the surface of the liquid is moved away from the liquid-leaving area and discharged out of the transfer tank.

15. The method for collecting a liquid surface residual film for liquid pressure transfer according to claim 14, wherein the side oppositely-separating flow is formed by second overflow tanks provided at a stage subsequent to the first overflow tanks for collecting the liquid surface residual film, and in a discharge port serving as a liquid collecting port of the second overflow tanks, a flow rate increase brim is formed to increase a flow rate of the transfer liquid introduced into the second overflow tanks.

16. The method for collecting a liquid surface residual film for liquid pressure transfer according to claim 15, wherein in the liquid-leaving area, air blows to push a bubble and a foreign substance generated on the surface of the liquid-leaving area to one of the side walls of the transfer tank, and together with the discharge of the foreign substance accumulated in the transfer liquid and on the surface of the liquid, the bubble and the foreign substance on the surface of the liquid in the area are also collected by the second overflow tanks for forming the side oppositely-separating flow, so that the bubble and the foreign substance are discharged out of the tank.

* * * * *